US008446358B2

(12) United States Patent
Sakamoto

(10) Patent No.: US 8,446,358 B2
(45) Date of Patent: May 21, 2013

(54) IMAGE DISPLAY DEVICE HAVING MEMORY PROPERTY, DRIVING CONTROL DEVICE AND DRIVING METHOD TO BE USED FOR SAME

(75) Inventor: Michiaki Sakamoto, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 848 days.

(21) Appl. No.: 12/425,020

(22) Filed: Apr. 16, 2009

(65) Prior Publication Data

US 2009/0267969 A1 Oct. 29, 2009

(30) Foreign Application Priority Data

Apr. 16, 2008 (JP) ..... 2008-107353
Apr. 16, 2009 (JP) ..... 2009-100415

(51) Int. Cl.
*G09G 3/34* (2006.01)

(52) U.S. Cl.
USPC ..... 345/107; 345/214; 345/690; 359/296

(58) Field of Classification Search
USPC ..... 345/107, 55, 84, 105, 108, 211, 214, 345/690–693; 359/296
See application file for complete search history.

(56) References Cited

U.S. PATENT DOCUMENTS 6,531,997 B1 * 3/2003 Gates et al. ..... 345/107
6,567,217 B1 * 5/2003 Kowarz et al. ..... 359/618
7,269,524 B1 * 9/2007 Ong et al. ..... 702/69
7,425,941 B2 * 9/2008 Sung et al. ..... 345/98
7,525,559 B2 * 4/2009 Furukawa et al. ..... 345/690
2003/0086179 A1 * 5/2003 Kowarz et al. ..... 359/627
2005/0179641 A1 * 8/2005 Zhou et al. ..... 345/107
2005/0280626 A1 * 12/2005 Amundson et al. ..... 345/107
2006/0023001 A1 * 2/2006 Sung et al. ..... 345/690
2006/0132426 A1 * 6/2006 Johnson ..... 345/107
2006/0202948 A1 * 9/2006 Johnson et al. ..... 345/107

(Continued)

FOREIGN PATENT DOCUMENTS

JP 60-073678 A 4/1985
JP 05-158446 A 6/1993

(Continued)

OTHER PUBLICATIONS

Office Action issued by the Japanese Patent Office in Japanese Application No. 2009-100415 dated Dec. 11, 2012.

(Continued)

*Primary Examiner* — Dimitriy Bolotin
(74) *Attorney, Agent, or Firm* — Sughrue Mion, PLLC

(57) ABSTRACT

There is provided an image display device capable of obtaining a renewed screen giving normal feelings by simple LUT (Look Up Table) adjustment even at a time of displaying with multiple gray levels. A screen of the electronic paper section making up the display device is renewed by driving for a period of time corresponding to a plurality of frames according to input gray level data of a renewed screen. The renewed screen is displayed with a coarse gray level during a first displaying period in a renewing period corresponding to a plurality of frames at an output voltage specified by a high-order bit of its gray level data and, thereafter, is displayed with a fine gray level during a second displaying period in the renewing period at an output voltage specified by a low-order bit of its gray level data.

20 Claims, 23 Drawing Sheets

U.S. PATENT DOCUMENTS

| | | | | |
|---|---|---|---|---|
| 2006/0232547 | A1* | 10/2006 | Johnson et al. | 345/107 |
| 2006/0244391 | A1* | 11/2006 | Shishido et al. | 315/169.3 |
| 2007/0035488 | A1* | 2/2007 | Kimura | 345/77 |
| 2007/0247417 | A1* | 10/2007 | Miyazaki et al. | 345/107 |
| 2008/0284719 | A1* | 11/2008 | Yoshida | 345/102 |
| 2008/0309648 | A1* | 12/2008 | Erol et al. | 345/204 |
| 2010/0060673 | A1 | 3/2010 | Roosendaal et al. | |

FOREIGN PATENT DOCUMENTS

| | | | |
|---|---|---|---|
| JP | 08-065164 | A | 3/1996 |
| JP | 2000-147466 | A | 5/2000 |
| JP | 2006-267982 | A | 10/2006 |
| JP | 2007-316594 | A | 6/2007 |
| JP | 2007-178785 | A | 7/2007 |
| JP | 2008-076848 | A | 4/2008 |
| JP | 2010-511197 | A | 4/2010 |
| WO | 2008/065608 | A1 | 6/2008 |

OTHER PUBLICATIONS

Office Action issued by the Japanese Patent Office in Japanese Patent Application No. 2009-100415 dated Mar. 5, 2013.

* cited by examiner (1) 15th Gray Level (1111)
Pixel Voltage
+15V (10)
0V (00)
−15V (01)
High-order Bit Displaying Period
Low-order Bit Displaying Period
0
30
60
90
Time (Frame)
(2) 14th Gray Level (1110)
Pixel Voltage
+15V (10)
0V (00)
−15V (01)
Time
(3) 13th Gray Level (1101)
Pixel Voltage
+15V (10)
0V (00)
−15V (01)
Time
(4) 12th Gray Level (1100)
Pixel Voltage
+15V (10)
0V (00)
−15V (01)
Time

(13) 3rd Gray Level (0011)
Pixel Voltage
+15V (10)
0V (00)
−15V (01)
High-order Bit Displaying Period
Low-order Bit Displaying Period
0
30
60
90
Time (Frame)
(14) 2nd Gray Level (0010)
Pixel Voltage
+15V (10)
0V (00)
−15V (01)
Time
(15) 1st Gray Level (0001)
Pixel Voltage
+15V (10)
0V (00)
−15V (01)
Time
(16) 0 Gray Level (0000)
Pixel Voltage
+15V (10)
0V (00)
−15V (01)
Time

*FIG.6*

| N \ C | 0000 | 0001 | 0010 | 0011 | ···1111 |
|---|---|---|---|---|---|
| 00(B) | 10 | 10 | 10 | 10 | 10 |
| 01(DG) | 10 | 10 | 10 | 10 | 10 |
| 10(LG) | 01 | 01 | 01 | 01 | 01 |
| 11(W) | 01 | 01 | 01 | 01 | 01 |

IMAGE DISPLAY DEVICE HAVING MEMORY PROPERTY, DRIVING CONTROL DEVICE AND DRIVING METHOD TO BE USED FOR SAME

INCORPORATION BY REFERENCE

This application is based upon and claims the benefit of priorities from Japanese Patent Application No. 2008-107353, filed on Apr. 16, 2008 and Japanese Patent Application No. 2009-100415, filed on Apr. 16, 2009, the disclosures of which are incorporated herein in its entirely by reference.

BACKGROUND OF THE INVENTION

1. Field of the Invention

The present invention relates to an image display device having a memory property, a driving control device and driving method to be used for the same; and more particularly to the image display device having a memory property being suitably used in an electronic paper display device such as an electronic book and electronic newspaper and to the driving control device and driving method to be used for the image display device.

2. Description of the Related Art

As a display device enabling an act of "reading" without the reader feeling stress, an electronic paper display device called an electronic book, electronic newspaper, and the like is under development. It is required that the electronic paper display device of this kind is thin, light-weight, hard to crack and consumes less power and, therefore, it is preferable that the electronic paper display device is made up of a display device having a memory property. Conventionally, as a display element to be used for the display device having a memory property, an electrophoretic element, electronic liquid powder display, cholesteric liquid crystal display device and a like are known. Among them, an electrophoretic display device using a microcapsule-type electrophoretic element is receiving attention.

FIG. 21 is a partial cross-sectional view schematically showing a diagrammatic configuration of an electrophoretic display device of an active matrix driving type. The electrophoretic display device, as shown in FIG. 21, is made up of a TFT (Thin Film Transistor) glass substrate 1, an electrophoretic element film 2, and a facing substrate 3, all of which is stacked in layers in this order. On the TFT glass substrate 1 are mounted many thin film transistors (hereafter "TFTs") 4 serving as switching elements arranged in a matrix form, pixel electrodes 5 each being connected to each of the TFTs 4, gate lines 6, data lines (not shown), and light shielding films 7 each covering the TFTs 4. The above electrophoretic element film 2 is made up of microcapsules 9, 9, . . . being about 40 μm in size which are spread over a polymer binder 8. Each of the microcapsules 9, 9, . . . is filled with a solvent 10. In the solvent 10 are trapped, in a manner to be spread and to allowed to float, an infinite number of positively or negatively charged nano-sized particles, that is, white pigment particles 11, 11, . . . such as negatively charged titanium oxide particles and black pigment particles 12, 12, . . . such as positively charged carbon particles. Moreover, on the above facing substrate 3 is mounted a facing electrode 13 to supply a reference potential.

The electrophoretic display device performs its operations by applying a voltage corresponding to image data between pixel electrodes 5 and facing electrodes 13 and moving white pigment particles 11, 11, . . . and black pigment particles 12, 12, . . . up and down. That is, when a positive voltage is applied to the pixel electrode 5, the negatively charged white pigment particles 11, 11, . . . are attracted toward the pixel electrodes 5, whereas and a positively charged black pigment particles 12, 12, . . . are attracted toward the facing electrode 13 and, therefore, if the facing electrode 13 side is used as a display face, black is displayed on the screen. On the other hand, when a negative voltage is applied to the pixel electrode 5, the positively charged black pigment particles 12, 12, . . . are attracted toward the pixel electrodes 5 and, whereas negatively charged white pigment particles 11, 11, . . . are attracted toward the facing electrode 13 and, therefore, white is displayed on the screen. When an image is to be switched from white display to black display, a positive signal voltage is applied to the pixel electrode 5. When the image is to be switched from black display to black display, a negative signal voltage is applied to the pixel electrode 5. When a present image is maintained, that is, when the image is switched from white display to white display and from black display to white display, a 0V voltage is applied to the pixel electrode 5. Thus, since the electrophoretic display element has a memory property, by comparing a previous screen with a subsequent screen (renewed screen), a signal voltage to be applied is determined.

Next, a TFT driving method for active-matrix type electrophoretic display device is described. In the TFT driving method of the electrophoretic display element, as in the case of a liquid crystal display device, a gate signal is applied to the gate lines 6 to perform a shift operation for every frame and a data signal is written through the TFTs 4 of the switching element to the pixel electrodes 5. Time required for completion of writing of all lines is defined as "one frame" and one frame scanning is performed for, for example, at 60 Hz (=16.6 ms). In general, in a liquid crystal display device, an entire image is switched within 1 frame. On the other hand, the response speed of the electrophoretic element is slower than that of the liquid crystal display device and image switching cannot be made unless a voltage continues to be applied for a plurality of frame periods and, therefore, in the electrophoretic display device, a PWM (Pulse Width Modulation) driving method is used in which a constant voltage continues to be applied for a plurality of frame periods.

In the electrophoretic display device providing a slow response speed, when an image is to be renewed, it is necessary that a history of a previous screen is deleted. In the non-patent reference document 1 (SID Technical Digest [2006, P1406, Improved Electronic Controller for Image Stable Display]), a reset driving method is disclosed in which, to delete a history of a previous screen, after a screen is first reset by displaying black and then white on an entire screen, a renewed screen is displayed.

Next, the reset driving method disclosed in the non-patent reference document 1 is described by referring to FIG. 22. For the convenience of descriptions, it is assumed that the response speed of the electrophoretic display element is, for example, 0.5 sec and a frame frequency is 60 Hz.

In the reset driving method, when image display is to be switched, a voltage (pixel voltage) of +15V is first applied continuously for a period of time corresponding to a response speed of the electrophoretic display element (time corresponding to the response speed), for example, about 0.5 sec to display black. As shown in FIG. 22, a pixel voltage of +15V is continuously applied to the electrophoretic display element for frame period of N1 (hereinafter, N1 frame time). Here, the N1 frame corresponds to 30 frames (500 ms/16.6 ms). After N1 frame time has elapsed, a pixel voltage of −15V is continuously applied to the electrophoretic display element for a period of time corresponding to N2 frame (30 frames) to display white on a screen. Thus, after resetting the entire screen by black and white, an image on a subsequent screen (renewed screen) is displayed with a specified gray level.

The gray level display is performed by applying a voltage of +15V for a period of time defined according to a gray level of a subsequent screen (renewed screen) within a period of time corresponding to N3 frames (30 frames). That is, when white is to be displayed (with 15th gray level) on a subsequent screen, white has already been displayed on the previous screen and, therefore, no voltage is applied on the subsequent screen. When black is to be displayed (with 0th gray level) on a subsequent screen, a voltage of +15V is continuously applied for periods (30 frames) corresponding to the response speed of the electrophoretic display element. Moreover, the display of an image with an intermediate gray level can be realized by decreasing count of frames for which a voltage of +15V is continuously applied according to gray level (luminance). That is, when an image is to be displayed with 14th gray level on a subsequent screen, a voltage of +15V is applied for a period of time corresponding to 2 frames and, when an image is to be displayed with 13h gray level on the subsequent screen, a voltage of +15V is applied for a period of time corresponding to 4 frames, and when an image is to be displayed with (15−n)th gray level on the subsequent screen, a voltage of +15V is applied for a period of time corresponding to 2n frames, and further when an image is to be displayed with 1st gray level on the subsequent screen, a voltage of +15V is applied for a period of time corresponding to 28 frames.

In the reset driving method, due to necessity of display of a redundant reset screen, there is a fear of degrading the display performance. To solve this problem, a previous screen reference driving method is disclosed in which a voltage to be applied is determined by using a look up table (Look Up Table, hereinafter simply an LUT) being a table showing a specified conversion coefficient group used to calculate a data signal from gray level data of a previous screen and gray level data of a renewed screen.

However, the previous screen reference driving method has a shortcoming in that, the reset screen display can be omitted at time of screen renewal and, as a result, the method is excellent in display performance, however, unless the LUT is properly set, a slight previous screen is left, that is, an after-image phenomenon occurs.

There is, however, another problem in that, as the gray level becomes multiple from 16→32→64 gray levels, the configuration of the LUT becomes the more complicated, which causes a difficulty in adjustment for obtaining an excellent image.

For example, in the previous screen reference method, a voltage has to be determined according to the LUT set for every frame from gray level data of a previous screen and gray level of a subsequent screen. Therefore, it is necessary that the LUT having a group of conversion coefficients (16×16, 32×32, and 64×64) of a previous image (4 bits=16 gray levels, 5 bits=32 gray levels, 6 bits=64 gray levels) and a renewed image (4 bits=16 gray levels, 5 bits=32 gray levels, 6 bits=64 gray levels) corresponding to frames required for renewing driving operations. To satisfy this, a process of determining huge pieces of matrix data is required, thus causing the LUT adjustment required for obtaining an appropriate image to be complicated.

Moreover, there is a contradiction that the improvement of a response speed of the electrophoretic element causes the difficulty in multiple gray level display. For example, the response speed of the electrophoretic element in driving at 15V is improved from 500 ms to 125 ms. In the case of the number of frame frequencies being 60 Hz, for the electrophoretic element having a response speed of 125 ms to achieve screen renewal from white to black, a voltage of +15V has to be continuously applied for a period of time corresponding to 30 frames. However, if the electrophoretic element having the response speed of 125 ms is used, a voltage of +15V is simply applied, under a condition of 125 ms/16.6 ms=7, for a period of time corresponding to 5 frames, which can improve the response property.

However, in the latter case, a display shift from white to black occurs for a period of time corresponding to 7.5 frames. For this reason, there remains an inconvenience problem in that multiple gray level display with 8 gray levels at most can be realized according to the above-mentioned driving method. Thus, another technological problem arises that, in order to achieve display with 16 gray levels, a frame frequency has to be raised from 60 Hz to 300 Hz, which causes a rise in power consumption and insufficient writing of signals to a data driver or TFT, as a result, making it impossible to be used in high-definition panel. On the other hand, it can be envisioned that a response speed is made slow by lowering the driving voltage from 15V to 8V, however, the effort of having improved the response speed of the electrophoretic element proves fruitless.

SUMMARY OF THE INVENTION

In view of the above, it is a first object of the present invention to provide an image display device having a memory property capable of improving a renewing speed of an image and achieving multiple gray level display without causing an increase in the number of frame frequencies and a driving control device and driving method to be used for the image display device. It is a second object of the present invention to provide an image display device having a memory property and excellent display quality by simple LUT (Look Up Table) adjustment even at times of multiple gray level display, a driving control device and driving method to be used for the image display device.

According to a first aspect of the present invention, there is provided an image display device having a memory property including a display section made up of a display element having a memory property, a driving unit to drive the display section at a specified output voltage, and a control unit (driving control device) to control the driving unit, wherein a screen of the display section is renewed by driving for a period of time corresponding to a plurality of frames according to input gray level data of a renewed screen and wherein the control unit makes the driving unit display the renewed screen with a coarse gray level at the specified voltage specified by a high-order bit of gray level data of the renewed screen during a first displaying period in a renewing period corresponding to the plurality of frames and, thereafter, makes the driving unit display the renewed screen with a fine and minute gray level at the specified output voltage specified by a low-order bit of gray level data of the renewed screen during a second displaying period in the renewing period.

According to a second aspect of the present invention, there is provided a driving method to be used in an image display device having a display section made up of a display element having a memory property, a driving unit to drive the display section at a specified output voltage, and a control unit to control the driving unit and to renew a screen of the display section by driving for a period of time corresponding to a plurality of frames according to input gray level data of a renewed screen and the driving method includes a step of dividing a renewing period corresponding to the plurality of frames into, at least, a first displaying period and a second displaying period, a step of making the driving unit display the renewed screen with a coarse gray level at the output voltage specified by a high-order bit of gray level data of the renewed screen during the first displaying period and, thereafter, making the driving unit display the renewed screen with a fine and minute gray level at the output voltage specified by a low-order bit of gray level data of the renewed screen during the second displaying period.

According to a third aspect of the present invention, there is provided a driving control device to be used for an image display device having a memory property including a display section with a display element having a memory property, a driving unit to drive the display section at a specified output voltage, and a control unit to control the driving unit, the driving control device which functions as the control unit, wherein, at time when a screen of the display section is renewed by driving for a period of time corresponding to a plurality of frames according to input gray level data of a renewed screen, the driving unit displays the renewed screen with a coarse gray level at the specified output voltage specified by a high-order bit of gray level data of the renewed screen during a first displaying period in a renewing period corresponding to a plurality of frames and, thereafter, the driving unit displays the renewed screen with a fine and minute gray level at the specified output voltage specified by a low-order bit of gray level data of the renewed screen during a second displaying period in the renewing period.

With the above configuration, after an image is displayed with a coarse gray level during the first displaying period, during a subsequent second displaying period, an image is displayed with gray levels that become gradually finer and minuter and, therefore, even at time of renewing a screen, image display with less abnormal feelings can be realized.

Moreover, by dividing a renewing period corresponding to the plurality of frames, during the first displaying period, gray level display of the renewed screen is performed by using only a high-order bit of gray level of the renewed screen and, during the second displaying period, gray level display is performed by using only a low-order bit of gray level of the renewed screen, whereby the LUT configurations can be simplified and matrix data can be deleted. As a result, the adjustment of the LUT required for obtaining an appropriate image becomes simple and easy, thereby improving the display quality of an image.

BRIEF DESCRIPTION OF THE DRAWINGS

The above and other objects, advantages, and features of the present invention will be more apparent from the following description taken in conjunction with the accompanying drawings in which:

FIG. 6 is a conceptual diagram schematically showing an LUT used as an example in the driving method of the same electronic paper display device shown above;

DETAILED DESCRIPTION OF THE PREFERRED EMBODIMENTS

Best modes of carrying out the present invention will be described in further detail using various exemplary embodiments with reference to the accompanying drawings.

In an electrophoretic display device, an image is displayed with accumulated data on appropriate driving voltage waveforms applied for a period of time corresponding to a plurality of frames.

According to a first exemplary embodiment of the present invention, a driving period for display is divided into a high-order bit displaying period and a low-order bit displaying period, and fine and minute gray level control is exercised only in the low-order bit displaying period, thereby achieving a simplification of LUT (Look Up Table) configurations. Also, in a driving method of the exemplary embodiment, during the high-order bit displaying period, an image is displayed with coarse gray levels of 4 or so and, in a subsequent low-order bit displaying period, an image is displayed with gray levels that become gradually finer and minuter, therefore, at time of the renewal of a screen, image display giving less abnormal feelings is made possible.

According to a second exemplary embodiment of the present invention, more finer and minuter gray level control is employed, that is, a frame frequency is increased not in a high-bit display frame but in a low-bit display frame only, thus achieving a reduction in power consumption and display with multiple gray levels giving less abnormal feelings.

According to a third exemplary embodiment, a voltage to be applied to the electrophoretic display device is lowered not in the high-bit display frame but in the low-bit display frame only, thereby lowering a response speed in the low-bit display frame only and performing display with multiple gray levels giving less abnormal feelings and, as a result, achieving an improvement of screen renewing speed as a whole.

First Exemplary Embodiment

Hereinafter, exemplary embodiments of the present invention are described by referring to drawings.

Driving Method

Figure 1:
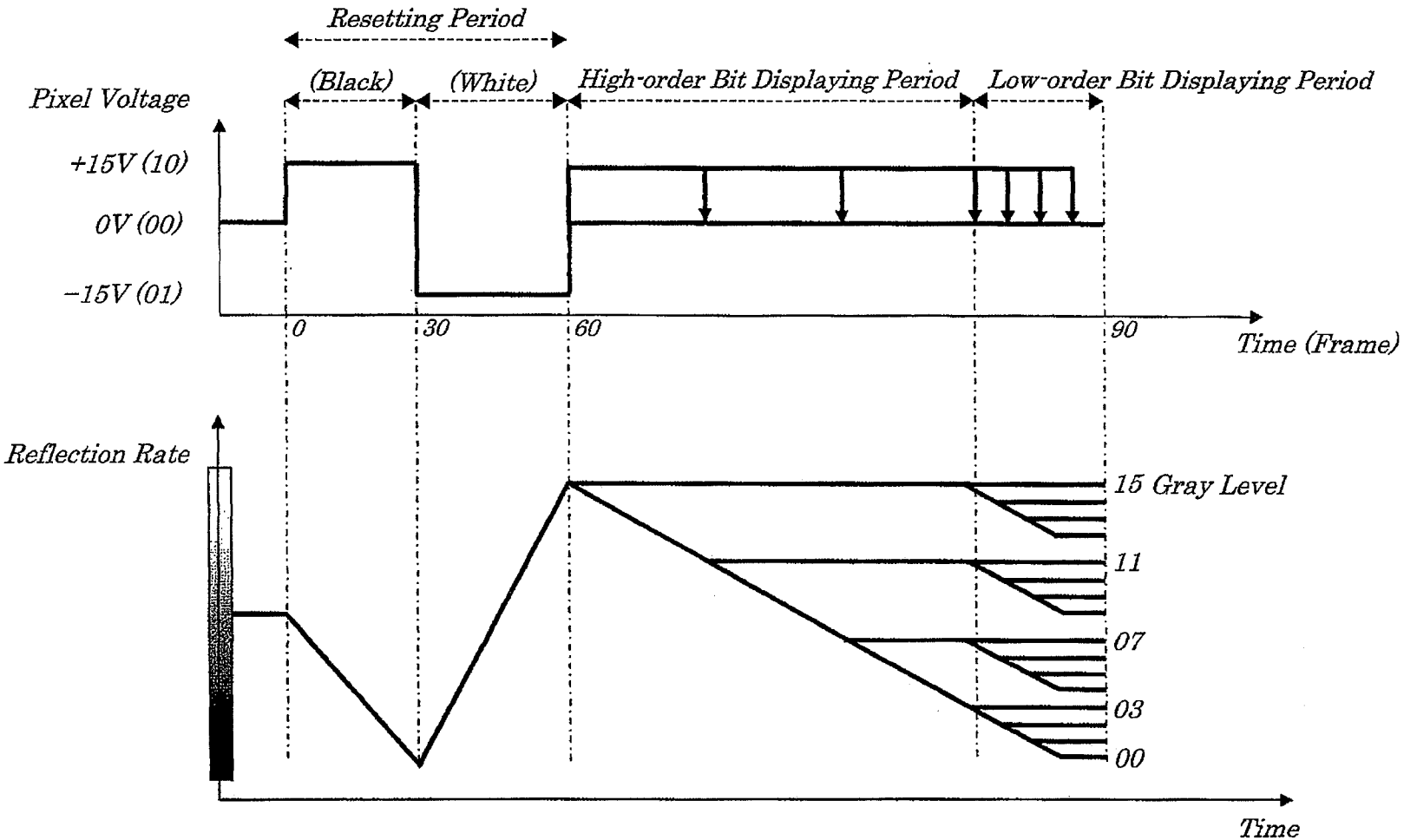
FIG. 1 is a diagram schematically showing a driving method for an electronic paper display device according to a first exemplary embodiment of the present invention.

FIG. 1 is a diagram schematically showing a driving method for an electronic paper display device of the first exemplary embodiment of the present invention. FIGS. 2 to 5 are diagrams used to explain the driving method of the above electronic paper display device and are waveform diagrams showing driving voltage waveforms to be applied to pixel electrodes for every gray level in input gray level data.

The electronic paper display device of the present invention is an electrophoretic type display device made up of an electrophoretic display element having a memory property to be driven by an active matrix method and suitably used for electronic books and/or electronic newspapers.

First, a driving method to be employed in the electronic paper display device for display with multiple gray levels is described by referring to FIG. 1.

The driving method of the first exemplary embodiment of the present invention is a driving method for renewing a specified image by driving for a period of time corresponding to a plurality of frames and the driving period corresponding to the plurality of frames is divided into a high-order bit displaying period during which an image is displayed with coarse gray levels by referring to a high-order bit of driving image data and a low-order bit displaying period during which an image is displayed with fine and minute gray levels by referring to a low-order bit of driving image data and display with multiple gray levels is achieved by sequentially driving for each frame period.

According to the driving method of the exemplary embodiment, as shown in FIG. 1, during the high-order bit displaying period, an image is displayed with coarse gray levels of 4 gray levels or so and, in a subsequent low-order bit displaying period, an image is displayed with gray levels that become gradually finer and minuter. Thus, after an image is displayed with coarse gray levels, an image is displayed with fine and minute gray levels, whereby image display giving less abnormal feelings is made possible.

Next, an example is specifiedally described in which, during the high-order bit displaying period, a renewed image is displayed with 4 gray levels (coarse gray levels) and, then during the low-order bit displaying period, a gradation image is displayed with 16 gray levels obtained by dividing each of the coarse gray levels further into 4 gray levels (fine and minute gray levels). Moreover, in the above example, a reset driving method is employed in which a history of a previous screen is deleted by displaying a black and white resetting screen irrespective of the previous screen.

First, in order to delete a trace on a previous screen, a screen resetting process is performed. In the resetting process, a voltage of +15V is continuously applied for a period of time (about 0.5 sec) corresponding to a response speed of the electrophoretic display element to display black (see FIGS. 2(1) to 5(16)). In the display device of the present invention, in the case where a frame frequency is set to be 60 Hz, black is displayed by continuously applying a voltage of +15V to the electrophoretic display element for a period of time corresponding to 30 frames (=0.5 sec×60 Hz). Then, by continuously applying a voltage of −15V for a period of time corresponding to 30 frames, white is displayed on the screen (see FIGS. 2(1) to 5(16)).

Next, display with multiple gray levels is performed in each of the high-order bit displaying period (coarse gray level displaying period) and low-order bit displaying period (fine and minute gray level displaying period). In the case of coarse gray level display, based on gray level data (input gray level data) for each pixel for a gradation image, when gray level data in the range of 0th to 3rd gray levels is inputted during the high-order bit displaying period, corresponding pixels are uniformly displayed with the 3rd gray level and, when gray level data in the range of 4th to 7th gray levels is inputted during the above period, corresponding pixels are uniformly displayed with the 7th gray level and, further, when gray level data in the range of 8th to 11th gray levels is inputted during the above period, corresponding pixels are uniformly displayed with the 11th gray level and, still further, when gray level data in the range of 12th to 15th gray levels is inputted during the above period, corresponding pixels are uniformly displayed with the 15th gray level (see Table 1).

Such display with coarse gray levels can be realized by ensuring 24 frames for the high-order displaying period. The reason for this is that gray level changes from white (15th gray level) to black (0th gray level) occur in a period of time corresponding to 30 frames and, therefore, the number of frames required for the gray level changes (maximum gray level change at the time of coarse gray level display) from white (the 15th gray level) to the 3rd gray level is 24 frames ([14−3]/[15−0]×30). More specifiedally, a voltage of 0V is applied for a period of time corresponding to 24 frames to pixel electrodes corresponding to 12th to 15th gray level data (see FIGS. 2(1) to 2(4) and Table 1). As a result, the corresponding pixels continue displaying white (with 15th gray level) during the high-order bit displaying period.

Figure 3:
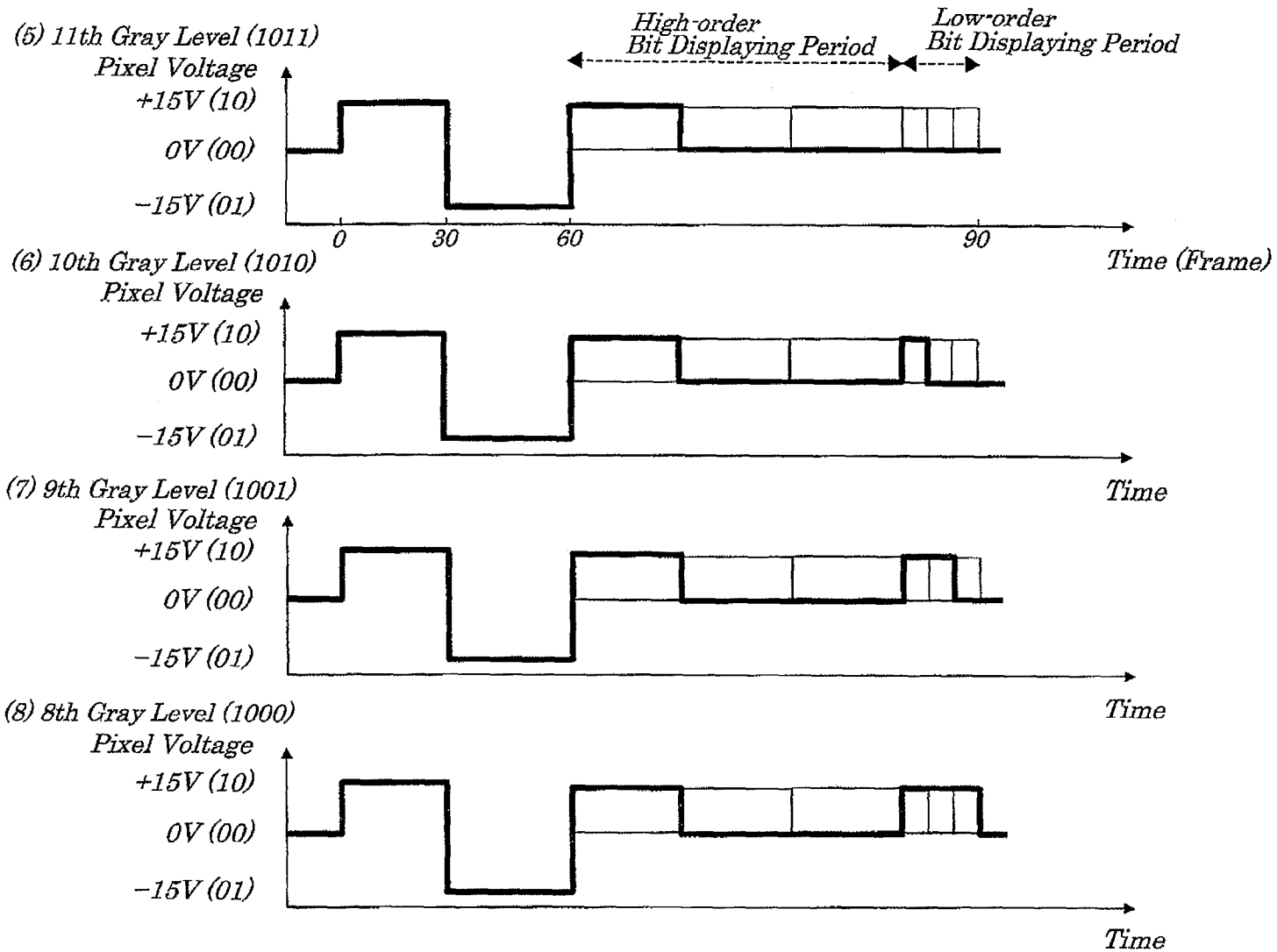
FIGS. 3(5) to 3(8) are also diagrams to explain the driving method of the same electronic paper display device and waveform diagrams (5) to (8) showing driving voltage waveforms to be applied to a pixel electrode for every gray level in input gray level data.
Figure 4:
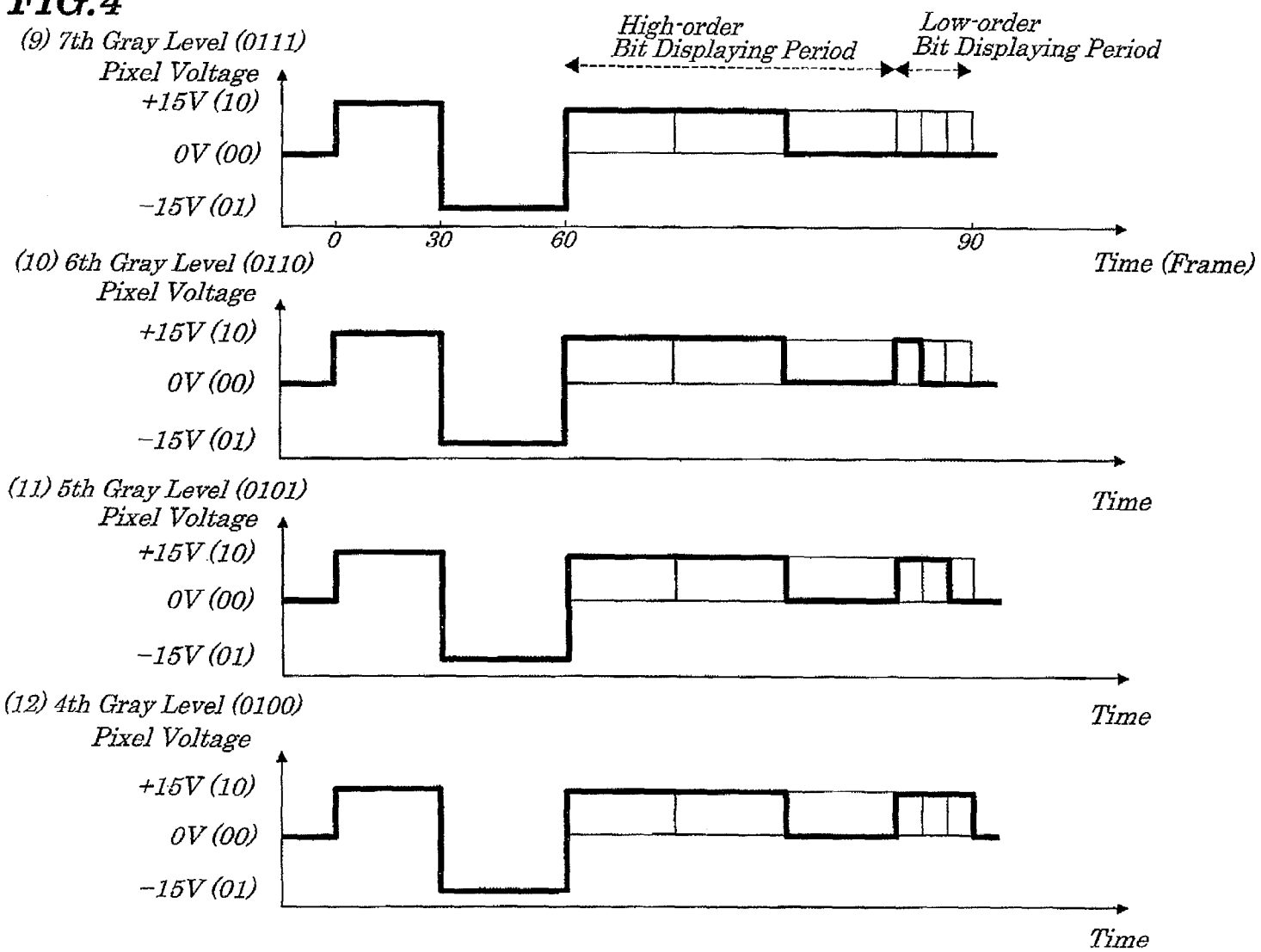
FIGS. 4(9) to 4(12) are also diagrams to explain the driving method of the same electronic paper display device and waveform diagrams (9) to (12) showing driving voltage waveforms to be applied to a pixel electrode for every gray level in input gray level data.

Next, to pixel electrodes corresponding 8th to 11th gray level data is applied a voltage of +15 for a period of time corresponding to 8 frames and a voltage of 0V for a period of time corresponding to the remaining 16 frames (see FIGS. 3(5) to 3(8) and Table 1). This causes the luminance of each of the corresponding pixels to be the 11th gray level. Also, to pixel electrodes corresponding to 4th to 7th gray level data is applied a voltage of +15V for a period of time corresponding to 16 frames and a voltage of 0V for a period of time corresponding to the remaining 8 frames (see FIGS. 4(9) to 4(12) and Table 1). This causes the luminance of each of the corresponding pixels to be the 7th gray level. Also, to pixel electrodes corresponding to 0th to 3rd gray level data is applied a voltage of +15V for a period of time corresponding to 24 frames (see FIGS. 5(13) to 5(16) and Table 1). This causes the luminance of each of the corresponding pixels to be the 3rd gray level. Thus, an image is displayed with 3rd gray level according to 0th to 3rd input gray level data. An image is displayed with 7th gray level according to 4th to 7th input gray level data. An image is displayed with 11th gray level according to 8th to 11th input gray level data. Also, an image is displayed with 15th gray level according to 12th to 15th input gray level data.

During the subsequent low-order bit displaying period, the separation (1) to fine gray levels; from the 3rd grade level (coarse gray level) to the 0th, 1st, 2nd, and 3rd gray levels, separation (2) to fine gray levels; from 7th gray levels (coarse gray level) to the 4th, 5th, 6th, and the 7th gray levels, separation (3) to fine gray levels; from the 11th gray level (coarse gray level) to the 8th, 9th, 10th, and 11th gray levels and, further, separation (4) to fine gray levels; from the 15th gray level (coarse gray level) to the 12th, 13th, 14th, and 15th gray levels, are simultaneously performed.

As a result, the low-order bit displaying period corresponding to 6 frames are used. That is, out of 30 frames required for gray level changes from white display to black display, 24 frames are used for the high-order bit displaying period and, as a result, the remaining 6 (30−24=6) frames are used for the low-order bit displaying period. Then, during the low-bit displaying period, when the input gray level data is any one of the 3rd, 7th, 11th, and 15th gray levels, the gray level is not changed from the gray level displayed at the time of termination of the high-order bit displaying period and, therefore, a voltage of 0V simply continues to be applied for a period of time corresponding to 6 frames (FIGS. 2[1], 3[5], 4[9] and 5[13]).

Figure 2:
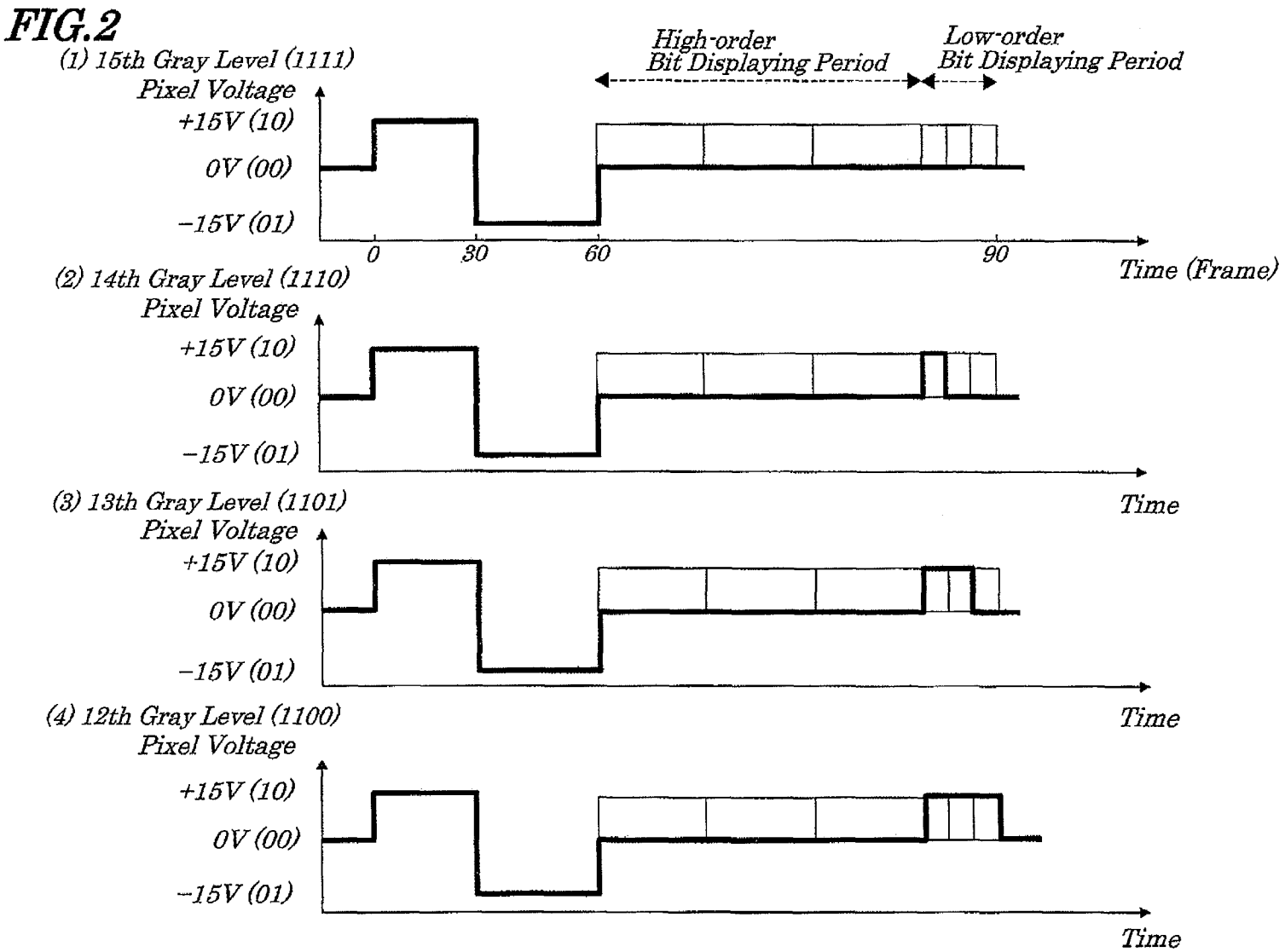
FIGS. 2(1) to 2(4) are also diagrams to explain the driving method of the same electronic paper display device and waveform diagrams (1) to (4) showing driving voltage waveforms to be applied to a pixel electrode for every gray level in input gray level data.

Next, when the input gray level data is any one of the 2nd, 6th, 10th, and 14th gray level data, it is necessary that the gray level is lowered (to be made darker) by one gray level from the gray level used at time of the termination of the high-order bit displaying period and, therefore, during a period of time corresponding to the first 2 frames, a voltage of +15V is applied and, during a period of time corresponding to the remaining 4 frames, a voltage of 0V is applied to make the gray level be darker (FIGS. 2 [2], 3 [6], 4 [10] and 5[14]).

Similarly, when the input gray level data is any one of the 1st, 5th, 9th, and 13th gray level data, it is necessary that the gray level is lowered (to be made darker) by two gray levels from the gray level used at time of the termination of the high-order bit displaying period and, therefore, during a period of time corresponding to the first 4 frames, a voltage of +15V is applied and, during a period of time corresponding to the remaining 2 frames, a voltage of 0V is applied to make the gray level be darker (FIGS. 2 [3], 3 [7], 4 [11] and 5[15]).

Further, when the input gray level data is any one of the 0th, 4th, 8th, and 12th gray level data, it is necessary that the gray level is lowered (to be made darker) by three gray levels from the gray level used at time of the termination of the high-order bit displaying period and, therefore, during a period of time corresponding to 6 frames in the low-bit order displaying period, a voltage of +15V is applied to make the gray level be darker (FIGS. 2[4], 3[8], 4[12] and 5[16]).

TABLE 1

| Gray level of input image | High-order bit of gray level | Low-order bit of gray level | High-order bit displaying period (V: voltage, F: Frame) | Low-order bit displaying period (V: voltage, F: Frame) |
|---|---|---|---|---|
| 15 | 11 | 11 | 0 V24F | 0 V6F |
| 14 | 11 | 10 | Same as above | 0 V4F, +15 V2F |
| 13 | 11 | 01 | Same as above | 0 V2F, +15 V4F |
| 12 | 11 | 00 | Same as above | +15 V6F |
| 11 | 10 | 11 | 0 V16F, +15 V8F | 0 V6F |
| 10 | 10 | 10 | Same as above | 0 V4F, +15 V2F |
| 9 | 10 | 01 | Same as above | 0 V2F, +15 V4F |
| 8 | 10 | 00 | Same as above | +15 V6F |
| 7 | 01 | 11 | 0 V8F, +15 V16F | 0 V6F |
| 6 | 01 | 10 | Same as above | 0 V4F, +15 V4F |
| 5 | 01 | 01 | Same as above | 0 V2F, +15 V4F |
| 4 | 01 | 00 | Same as above | +15 V6F |
| 3 | 00 | 11 | +15 V24F | 0 V6F |
| 2 | 00 | 10 | Same as above | 0 V4F, +15 V2F |
| 1 | 00 | 01 | Same as above | 0 V2F, +15 V4F |
| 0 | 00 | 00 | Same as above | +15 V6F |

Out of items on the column in Table 1, in the item of "Gray level of input image", each gray level out of 16 gray levels of input image data is represented by a decimal number. In the items of "High-order bit of gray level" and "Low-order bit of gray level" on the column, each gray level out of the 16 gray levels (=4 bits) is represented respectively as a high-order bit and as a low-order bit in a binary number. In the item of the "High-order bit displaying period" and "Low-order bit displaying period" on the column, a voltage to be applied and the number of frames (voltage applying period) for each image to be displayed during the high-order or low-order bit displaying period are shown.

It is understood from Table 1 that, among gray levels of the input gray level data, if their high-order bits are the same, their driving voltage waveforms to be applied to pixel electrodes during the high-order bit displaying period are the same and, if their low-order bits are the same, their driving voltage waveforms to be applied to pixel electrodes during the low-order bit displaying period are the same. Therefore, the driving voltage waveforms shown in FIGS. 2(1) to 5(16) can be realized by selecting the high-order bit or low-order bit of the gray level of input image data for every frame and preparing an LUT (Look Up Table) to determine a driving voltage based on the result from the selection.

Thus, when the resetting method is employed, gray level data of a pixel making up a previous screen is not referred to and, therefore, a driving voltage waveform of a pixel electrode can be determined only from gray level data on the pixel for a renewed screen. However, the resetting method has a shortcoming that, since a black and white reset screen is inserted during the renewal of the screen, no smooth switching of a screen is performed.

This shortcoming can be overcome by the driving method employed in the exemplary embodiment of the present invention in which a high-order bit on a renewed screen is displayed by smooth shift to a high-order bit displaying period from the displaying period for a previous screen and the renewed screen is displayed with finer and minuter gray levels during the lower 2 bit displaying period, thereby providing more normal feelings at the time of switching. (the application to the previous screen reference driving method).

According to the previous screen reference driving method, in order to determine a driving voltage waveform, it is necessary to refer to gray level data (or higher-order 2 bits thereof) of a pixel making up a previous screen and to gray level data of a pixel of a renewed screen. Therefore, the previous screen reference driving method can be realized by preparing, for every frame, an LUT made up of a group of specified conversion coefficients required to determine a data signal of a data driver from gray level data (or high-order 2 bits thereof) of a previous screen and from high-order 2 bits or low-order 2 bits of gray level data of a renewed screen.

Moreover, as another method for smooth switching of screens, the previous screen reference driving method using the driving method of the exemplary embodiment may be employed in which the insertion of a resetting screen is stopped as much as possible and black or white display out of the black and white resetting display is omitted.

LUT Creation and Conversion Method

Figure 5:
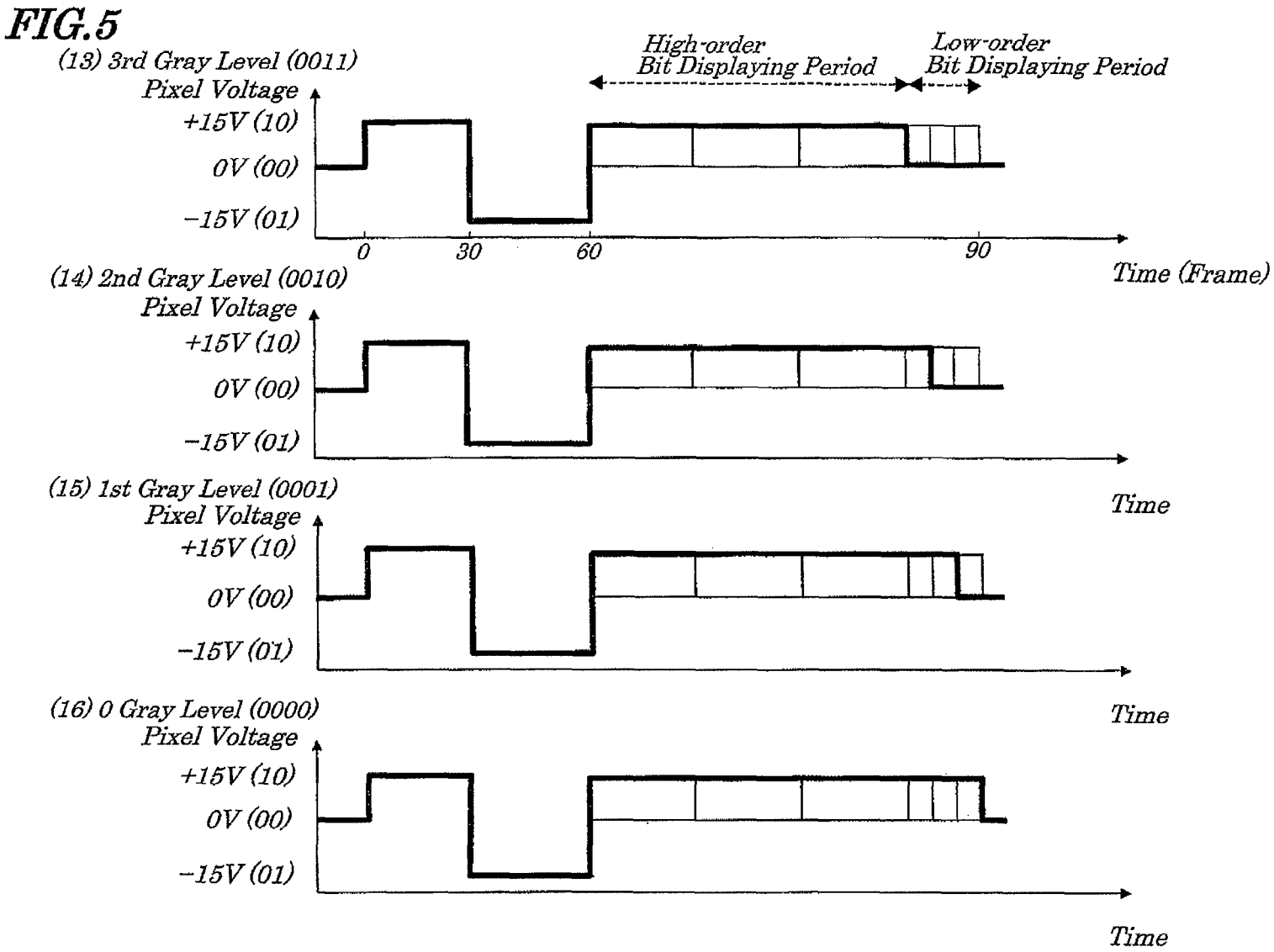
FIGS. 5(13) to 5(16) are also diagrams to explain the driving method of the same electronic paper display device and waveform diagrams (13) to (16) showing driving voltage waveforms to be applied to a pixel electrode for every gray level in input gray level data.

Next, the method for creating the LUT and converting data using the LUT to realize driving voltage waveforms shown in FIG. 2(1)) to FIG. 5(16) is described. For simplification, the method is explained by using the reset driving method in which a history of a previous screen is deleted by displaying a black and white resetting screen.

According to the reset driving method, a 16 gray-level renewed screen is realized during a period of time corresponding to 91 frames (about 1.5 sec) as a total including 60 frame time for a black and white resetting period (1 frame=16.6 ms [60 Hz]), 24 frame time for the consequent high-order bit displaying period, 6 frame time for the low-order bit displaying period, and 1 frame time (at 0V) for preventing power off with a needless voltage being applied to a pixel electrode. In FIGS. 2(1) to 5(16), driving voltage waveforms produced by the reset driving method in which 16 gray-level image is displayed during a period of time corresponding to 91 frames are shown.

To realize the driving voltage waveforms shown in FIGS. 2(1) to 5(16), LUT group data WFn (n=1 to 91) made up of LUTs corresponding to 91 frames is prepared.

Gray level data of a previous screen is not used in the reset driving method and, therefore, for simplification, the above method is explained by using the LUT having 4×1 matrix configurations. Here, the matrix element on the m-th row and n-th column in the LUT is represented by WFn(m) (m=00, 01, 10, 11, n=1, 2, 3, . . . , 90, 91). Here, the WFn represents the LUT for an n-th frame and the row (m) represents high-order 2 bit or low-order 2 bit gray level data of a renewed screen.

When a matrix element on each row is changed from gray level data of each pixel making up a reset screen to gray level data of a pixel on a previous screen, a driver data signal represented by a binary number is supplied to a data driver (described later) of an electronic paper display device. Here, the driver data signal takes values of [00], [01], and [10]. The driver data signal is supplied to a data driver of the electronic paper display device and is digital-analog (DAC) converted. When driver data signal [00] is supplied to the data driver, a voltage of 0V is outputted from the data driver. Also, when the driver data signal [01] is supplied to the data driver, a voltage of −V (negative voltage) is outputted from the data driver. When the driver data signal [10] is supplied to the data driver, a voltage of +V (positive voltage) is outputted from the data driver.

According to the image display device having the above configurations, in the resetting process, black is displayed on an entire screen during a period of time corresponding to the first to 30th frames and white is displayed on the entire screen during a period of time corresponding to the subsequent 31st to 60th frame to delete a history of a previous screen. In the period of time corresponding to 1st to 30th frames, irrespective of gray data of each pixel making up a renewed screen, a voltage +15V being a voltage for black display is uniformly applied and, therefore, WFn(00)=WFn(01)=WFn(10)=WFn(11)=[10] (=+15V), (n=1 to 30).

During a period of time corresponding to the subsequent 31st to 60th frame, irrespective of gray level data of each pixel making up a renewed screen, a voltage of −15V being a voltage for white display is uniformly applied to the pixel and, therefore, WFn(00)=WFn(01)=WFn(10)=WFn(11)=[01] (=−15V), (n=31 to 60).

Next, during a period of time corresponding to the 61st to 68-th frame in the high-order bit displaying period, when the high-order 2 bits of gray data (4 bits=16 gray levels) are [11] (that is, the 12th to 15th gray levels), a voltage of 0V is applied and, when the high-order 2 bits are [10], [01] or [00] (that is, the 0th to 11th gray levels), a voltage of +15V is applied and, therefore, WFn(00)=WFn(01)=WFn(10)=WFn(10)=[10] (=+15V), WFn(11)=[00] (=0V), (n=61 to 68).

Then, during a period of time corresponding to the 69th to 76th frame in the high-order bit displaying period, the high-order 2 bits of gray level data of a renewed screen are [11] or [10] (that is, the 8th to 15th gray levels), a voltage of 0V is applied and, when the high-order 2 bits are [01] or [00] (that is, the 0th to 7th gray levels), a voltage of +15V is applied and, therefore, WFn(00)=WFn(01)=10 (=+15V) and WFn(10)=WFn(11)=00 (=0V), (n=69 to 76).

Next, during a period of time corresponding to the 77th to 84th frame in the high-order bit displaying period, when the high-order 2 bits of gray level data of a renewed screen are [11], [10], or [01] (that is, the 4th to 15th gray levels), a voltage of 0V is applied and, when the high-order 2 bits are [00] (that is, the 0th to 3rd gray levels), a voltage of +15V is applied and, therefore, WFn(00)=[10] (=+15V) and WFn(01)=WFn(10)=WFn(11)=[00] (=0V), (n=77 to 84).

After the termination of the high-order bit displaying period, the low-order bit displaying period starts.

During a period of time corresponding to the 85th to 86th frame in the low-order bit displaying period, when the low-order 2 bits of gray level data on a renewed screen are [11] (that is, the 15th, 11th, 7th, and 3rd gray levels), a voltage of 0V is applied and, when the low-order 2 bits are not [11], a voltage of +15V is applied and, therefore, WFn(00)=WFn(01)=WF(10)=[10] (=+15V) and WFn(11)=[00] (=0V), (n=85 to 86).

During a period of time corresponding to the 87th to 88th frame in the low-order bit displaying period, when the low-order 2 bits of gray level data on the renewed screen are [11] or [10] (that is, the 15th, 14th, 11th, 10th, 7th, 6th, 3rd, 2nd gray levels), a voltage of 0V is applied and, when the low-order 2 bits are not [11] or [10], a voltage of +15V is applied and, therefore, WFn(00)=WFn(01)=[10] (=+15V) and WFn(10)=WFn(11)=[00] (=0V), (n=87 to 88).

Similarly, during a period of time corresponding to the 89th to 90th frame in the low-order bit displaying period, when the low-order 2 bits of gray level data on the renewed screen are [00] (that is, the 12th, 8th, 4th, 0th gray levels), a voltage of +15V is applied and, when the low-order 2 bits are not [00], a voltage of 0V is applied and, therefore, WFn(00)=[10] (=+15V) and WFn(01)=WFn(10)=WFn(11)=[00] (=0V), (n=89 to 90).

Finally, it is necessary to prepare a voltage of 0V for a period of time corresponding to 1 frame which is used to prevent the power-off with a needless voltage being applied to a pixel electrode and, therefore, during a period of time corresponding to the 91st frame, WFn(00)=WFn(01)=WFn(10)=WFn(11)=[00], (n=91).

Thus, in summary, the LUT group corresponding to FIGS. 2(1) to 5(16) is shown by Table 2. In the Table 2, [U] shows that, in the corresponding LUT, a high-order bit of gray level data on a renewed screen is selected and referred to, and [D] shows that, in the corresponding LUT, a low-order bit of gray level data on the renewed screen is selected and referred to.

TABLE 2

| Frame number | High-order (U), Low-order (D) | WFn(00) | WFn(01) | WFn(10) | WFn(11) |
|---|---|---|---|---|---|
| 1-30 | U | 10 | 10 | 10 | 10 |
| 31-60 | U | 01 | 01 | 01 | 01 |
| 61-68 | U | 10 | 10 | 10 | 00 |
| 69-76 | U | 10 | 10 | 00 | 00 |
| 77-84 | U | 10 | 00 | 00 | 00 |
| 85-86 | D | 10 | 10 | 10 | 00 |
| 87-88 | D | 10 | 10 | 00 | 00 |
| 89-90 | D | 10 | 00 | 00 | 00 |
| 91 | D | 00 | 00 | 00 | 00 |

In the above descriptions, for the reset driving method in which gray level data of a previous screen is not referred to, the LUT having the 4×1 matrix configuration is used, however, when general versatility of the LUT is taken into consideration, a generally versatile type LUT having a 4×16 matrix configuration being able to be employed in the previous screen reference driving method in which 4-bit gray level data of a previous screen can be referred to may be used.

The LUT group data WFn (n=1 to 91) made up of the generally versatile type LUT for 91 frames is the LUT data to be used for gray level data (16 gray levels, 4 bits) of a previous screen and high-order 2 bits or low-order 2 bits of gray-level data of a renewed screen. FIG. 6 shows the LUT group data WFn for the n-th frame in which its row data represents gray level data of high-order 2 bits or low-order 2 bits of a renewed screen and its column data represents gray level data (16 gray levels, 4 bits) of a screen before being renewed. When a matrix element of each row and column is changed from gray level data making up a previous screen to gray level data of a pixel for a renewed screen, a driver data is outputted which is to be supplied to a data driver of the electronic paper display device. In the LUT in FIG. 6, irrespective of a previous screen, in a given frame, if the renewed screen is white W ([11]) or light gray LG ([10]), a voltage of −15V ([01]) is outputted to the data driver and, if the renewed screen is black B ([00]) or dark gray DG ([01]), a voltage of +15V ([10]) is outputted to the data driver.

Moreover, the generally versatile type LUT is not limited to the LUT having a 4×16 matrix configuration and an LUT having a 4×4 matrix configuration allowing reference to high-order 2 bits making up gray level data of a previous screen may be used.

Further, in the above descriptions, the example is shown in which gray level display is performed by once making an entire screen be white and by gradually applying a black voltage, however, gray level display is not limited to this and may be performed by making an entire screen be black and by gradually applying a white voltage.

Circuit Configurations

Figure 7:
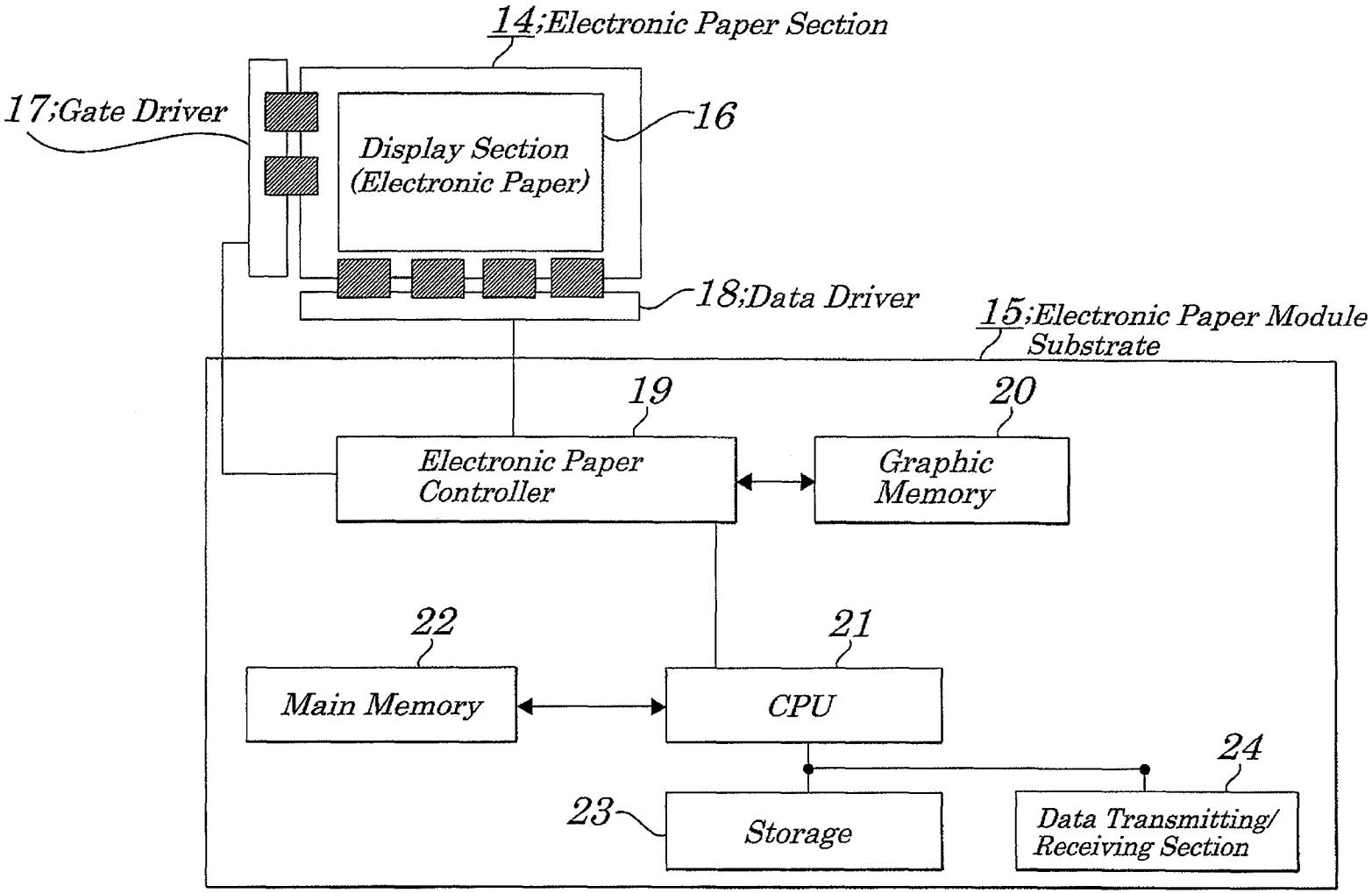
FIG. 7 is a block diagram showing electrical configurations of the same electronic paper display device.
Figure 8:
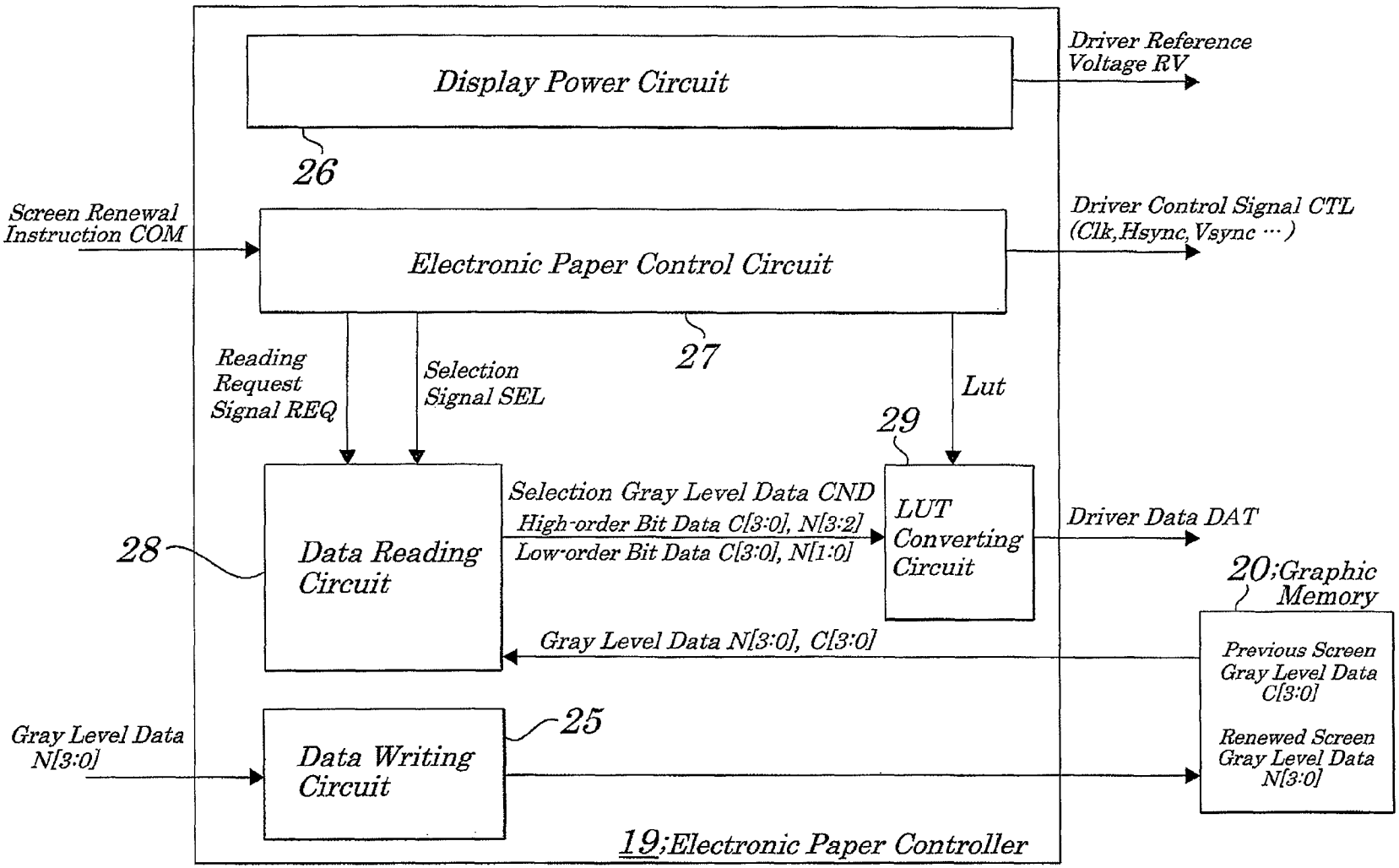
FIG. 8 is a block diagram showing electrical configurations of an electronic paper controller making up the same electronic paper display device.
Figure 11:
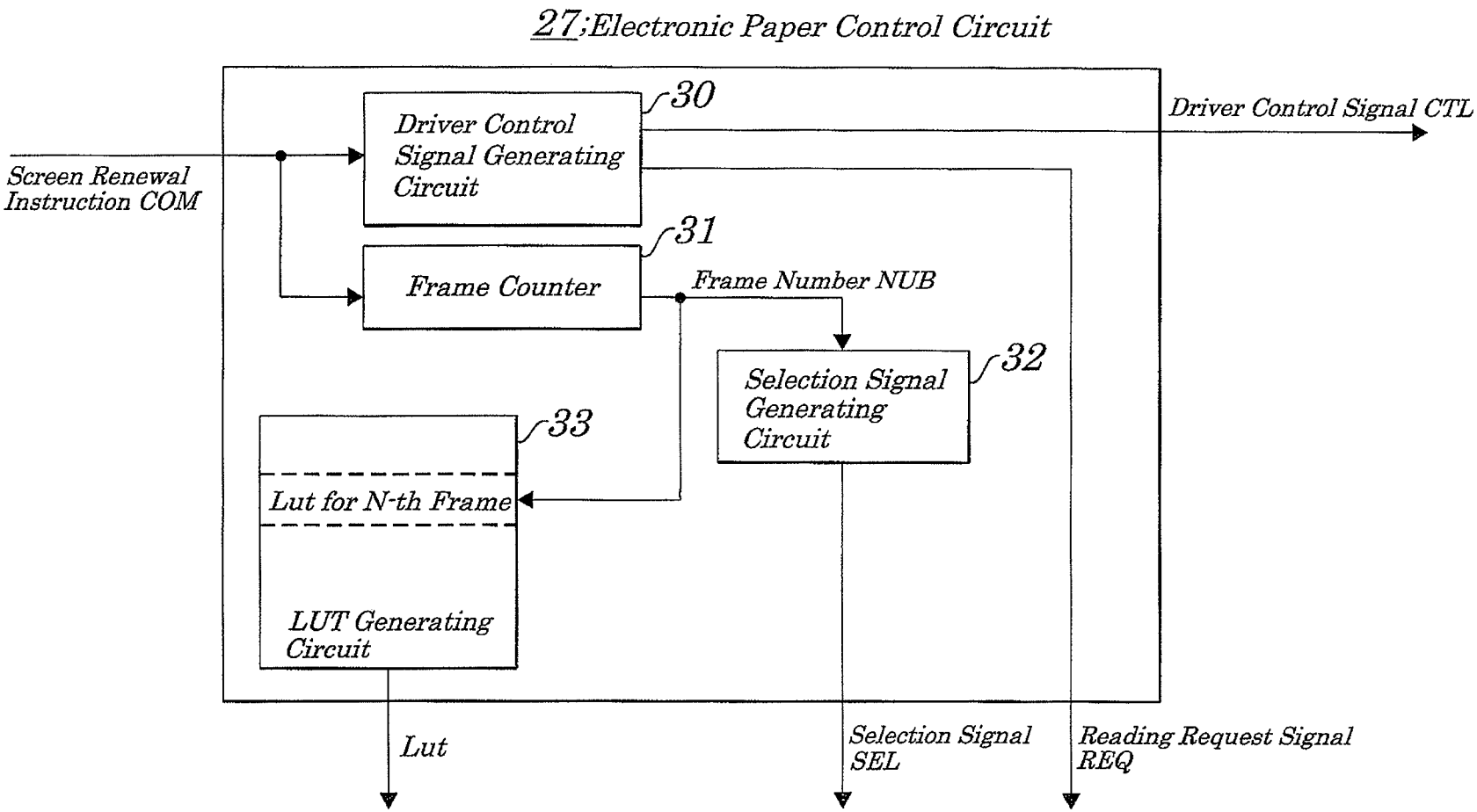
FIG. 11 is a block diagram showing electrical configurations of an electronic paper control circuit making up the same electronic paper controller.

FIG. 7 is a block diagram showing electrical configurations of the electronic paper display device shown above. FIG. 8 is a block diagram showing electrical configurations of an electronic paper controller making up the electronic paper display device. FIG. 11 is a block diagram showing electrical configurations of an electronic paper control circuit making up the electronic paper controller.

The electronic paper display device, as described above, is the display device to be driven according to the driving method of the exemplary embodiment and is made up of an electronic paper section 14 and an electronic paper module substrate 15. The electronic paper section 14 has a display section (electronic paper) 16 and a driver to drive the display section 16. The driver is made up of a gate driver 17 to perform a shift register operation and a data driver 18 to output ternary values.

Also, on the electronic paper module substrate 15 are mounted an electronic paper controller 19 to drive the electronic paper section 14, a graphic memory 20 making up a frame buffer, a CPU (Central Processing Unit) 21 to control each section of the devices and to supply image data to the electronic paper controller 19, a main memory 22 made up of ROM (Read Only Memory), RAM (Random Access Memory) or the like (not shown), storage 23 to store various image data and various programs, and a data transmitting/receiving section 24 made up of a wireless LAN (Local Area Network) or the like.

The electronic paper controller 19 described above has circuit configurations to realize driving voltage waveforms shown in FIGS. 2(1) to 5(16) by using the LUT group data WFn shown in Table 2 and, more specifiedally, as shown in FIG. 8, is made up of a data writing circuit 25, a display power circuit 26, an electronic paper control circuit 27, a data reading circuit 28, and an LUT converting circuit 29.

The data writing circuit 25 writes 4 bit gray-level data N[3:0] of a renewed image received from the CPU 21 into the graphic memory 20. The [3:0] of the gray level data represents that the number of bits is 4 and has positions 0 to 3 and the gray level data is made up of 16 gray levels. Any image may be used as a renewed image which the data transmitting/receiving section 24 has received from the outside or which has been, in advance, stored in the storage 23.

The graphic memory 20 has two frame buffer regions in which gray level data C [3:0] group of a previous entire screen and gray level data N[3:0] group of an entire renewed screen are stored.

The display power circuit 26 supplies a reference voltage RV (for example, +15V, 0V, and −15V) of the electronic paper section 14 to the data driver 18.

The electronic paper control circuit 27, when receiving a screen renewing instruction COM from the CPU 21, generates and outputs a control signal CTL, a selection signal SEL, a gray level data reading request signal REQ, and LUT data Lut. The control signal CTL is made up of a clock Clk, a horizontal sync signal Hsync, and a vertical sync signal Vsync and is inputted to the gate driver 17 and data driver 18 of the electronic paper section 14.

Further, the selection signal SEL selects either of a high-order bit or a low-order bit out of gray level data for every frame and is inputted into the data reading circuit 28 for every frame. The gray level data reading request signal REQ is generated for every clock (for every pixel) and inputted to the data reading circuit 28. The LUT data Lut is the LUT for every frame to determine driver data DAT representing a voltage value to be applied to the display section 16 of the electronic paper section 14, which is produced by the LUT producing method of the exemplary embodiment and is supplied to the LUT converting circuit 29 for every frame.

The data reading circuit 28, when receiving the selection signal SEL for every frame from the electronic paper control circuit 27 and the gray level reading request signal REQ for every clock (every pixel), reads gray level data C [3:0] of a previous screen and gray level data N [3:0] from the graphic memory 20. At this time point, if the selection signal SEL requests the high-order bit selection (U), the data reading circuit 28 selects the high-order bit gray level data N[3:2] for the renewed screen and, if the selection signal SEL requests the low-order bit selection (D), selects the low-order bit gray level data N[1:0]. Here, the N[3:2] represents the 2 to 3 positions from the N[3:0], that is, high-order 2 bit gray level data and the N[1:0] represents the 0 to 1 positions, that is, low-order 2 bit gray level data.

Figure 9:
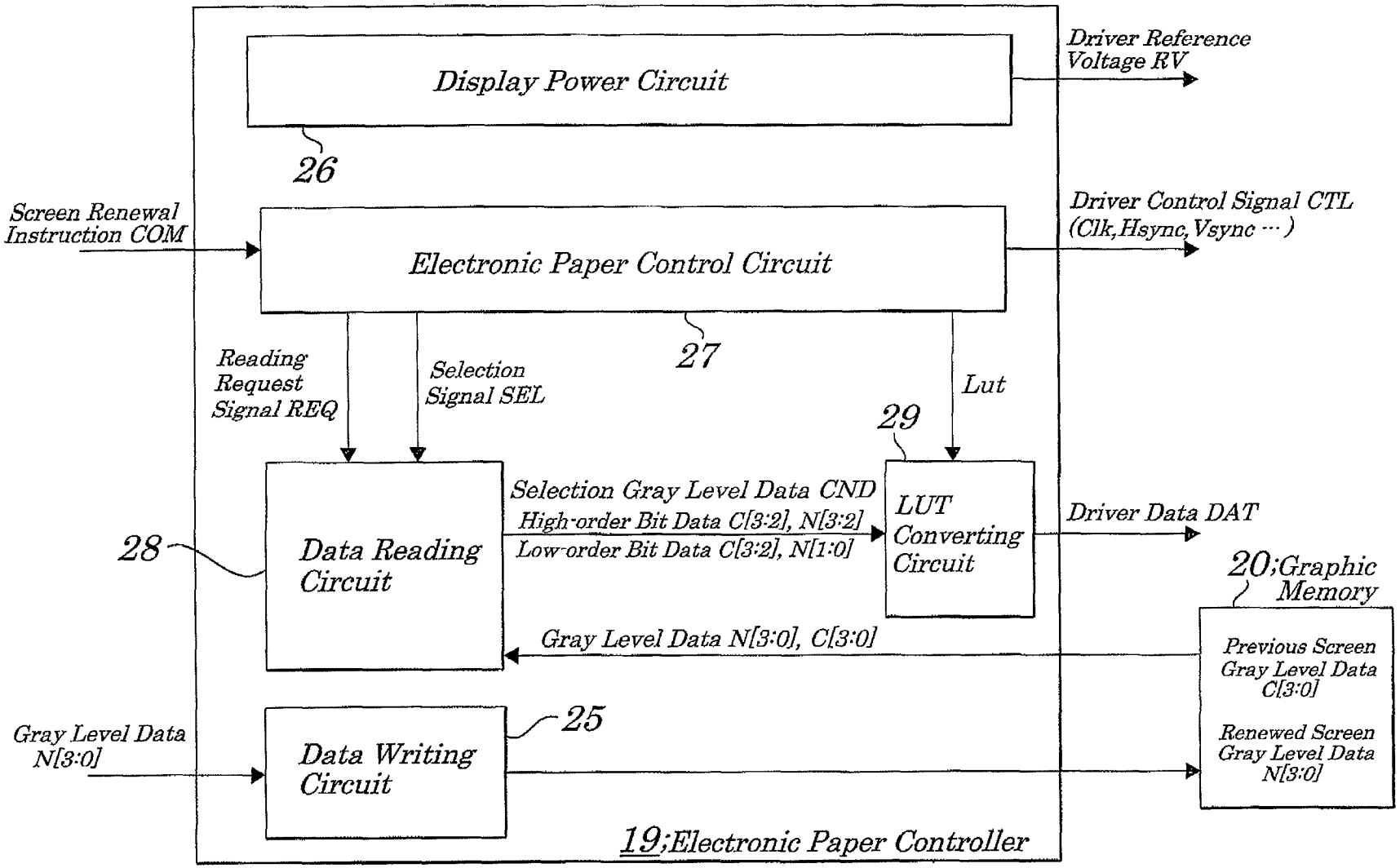
FIG. 9 is a block diagram showing a modified example of the electronic paper controller.
Figure 10:
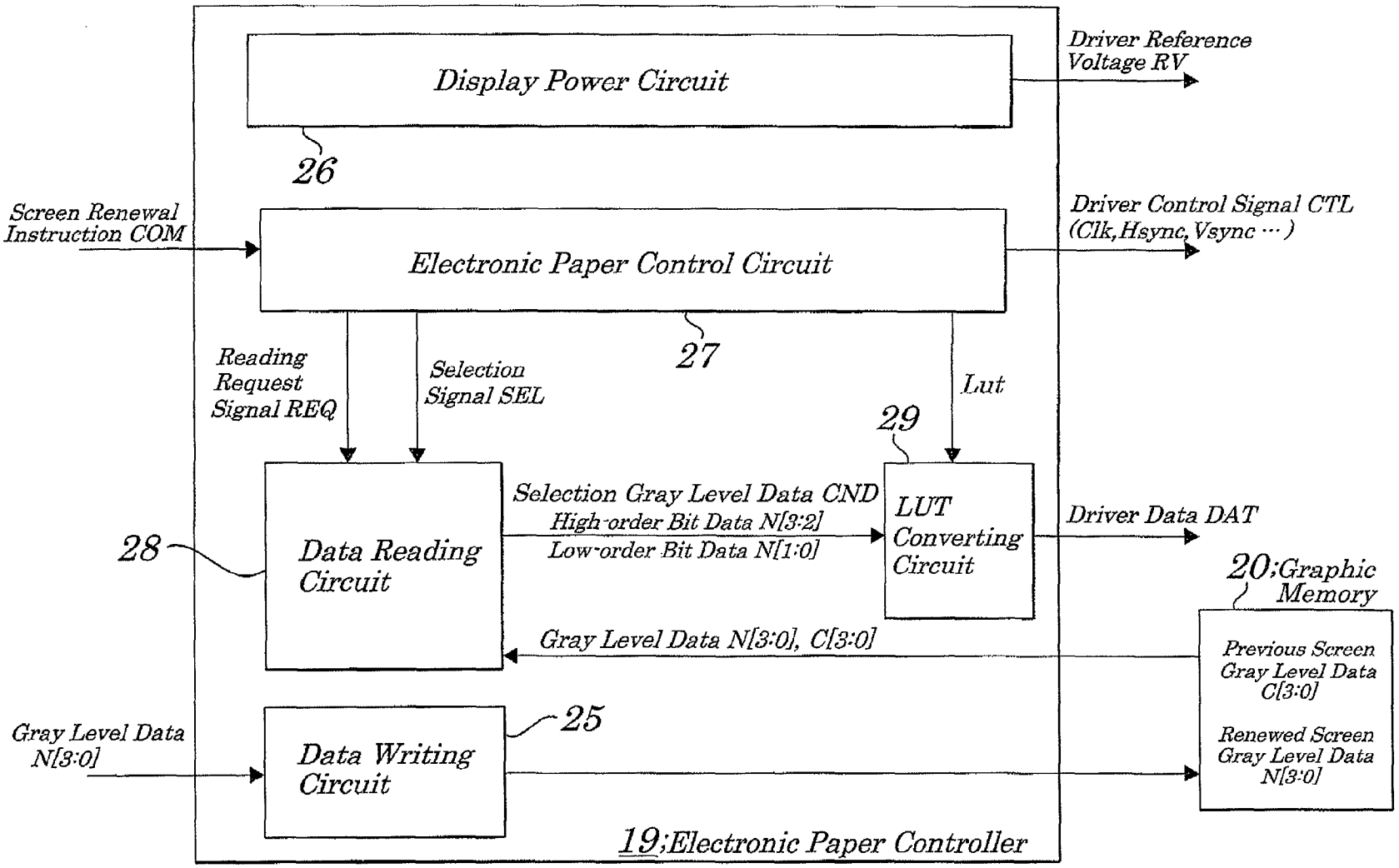
FIG. 10 is a block diagram showing another modified example of the electronic paper controller.

On the other hand, as the gray level data of a previous screen, as shown in FIG. 8, the 4-bit gray level data may be used, as it is, (C[3:0]), or as shown in FIG. 9, the high-order 2 bits out of the gray level data making up the previous screen may be fetched (C[3:2]) or the low-order 2 bits may be used, or as shown in FIG. 10, gray level data of a previous screen may be used.

The C[3:0] represents 0 to 3 positions from the C[3:0], that is, 4 bit gray level data. The C[3:2] represents 2 to 3 positions from the C[3:0], that is, high-order 2 bit gray level data. Moreover, for convenience of descriptions, in the following processing, as the previous screen gray data, 4 bit gray-level data is used.

The data containing high-order 2 bits of a renewed screen and gray level data of a previous screen (if required) are called selection gray-level data CND. In the case of the LUT configuration using gray level data of a previous screen, the high-order bit selection gray data CND is made up of gray level data C[3:0] of the previous screen and high-order 2 bit gray level data N[3:2] of the renewed screen and the low-order bit selection gray-level data CND is made up of gray level data C[3:0] of the previous screen and low-order 2 bit gray level data N[1:0] of the renewed screen (FIG. 8). In the case of the LUT configuration fetching and using the high-order 2 bits out of gray level data making up a previous screen, the high-order selection gray-level data CND is made up of gray level data C[3:2] of the previous screen and high-order gray level data N[3:2] of the renewed screen and low-order selection gray level data CND is made up of gray level data C[3:2] of a previous screen and low-order 2 bit gray level data N[1:0] of a renewed screen (see FIG. 9).

Further, in the case of the LUT configuration not using gray level data of a previous screen, the high-order bit selection gray-level CND data is made up of the high-order 2 bit gray level data N[3:2] only without containing gray level data of the previous screen and the low-order bit selection gray-level data CND and the low-order 2 bit selection gray-level data CND is made up of the low-order gray data of a renewed screen without containing gray level data of the renewed screen (FIG. 10). The selection gray-level data CND is sequentially outputted to the LUT converting circuit 29. Therefore, the data reading circuit 28 is connected to the graphic memory 20 and a signal line used to transmit the selection gray-level data CND is connected to the LUT converting circuit 29.

Also, the LUT converting circuit 29 converts the high-order or low-order bit selection gray-level data CND inputted from the data reading circuit 28 into driver data signal DAT according to the LUT data Lut to be inputted from the electronic paper control circuit 27.

Next, by referring to FIG. 11, electrical configurations of the electronic paper control circuit 27 are described in detail. The electronic paper control circuit 27 is made up of a driver control signal generating circuit 30, a frame counter 31, a selection signal generating circuit 32, and an LUT generating circuit 33. The driver control signal generating circuit 30, when receiving a screen renewing instruction COM from the CPU 21, outputs a driver control signal CTL to the gate driver 17 of the electronic paper section 14 and to the data driver 18 and outputs the gray level data reading request signal REQ for every clock (every pixel). The frame counter 31, when receiving the screen renewing instruction COM from the CPU 21, begins to count frames and counts up the number of frames required for renewal of a screen and outputs a frame number NUB showing what frame is presently in the process of driving.

The selection signal generating circuit 32 compares a frame number NUB with a reference frame number every time the frame number NUB is inputted and, when the frame number NUB is less than the reference frame number (Table 2), reads out the selection signal SEL for providing an instruction for the selection of the high-order bit selection (U) and outputs the read signal to the data reading circuit 28 and, when the frame number NUB reaches the reference frame number or when the frame number NUB exceeds the reference frame number (Table 2), outputs the selection signal SEL for providing an instruction for the selection of the low-order bit selection (D) to the data reading circuit 28. In the above LUT generating circuit 33, the LUT group data WFn described for every frame is stored in the LUT (see FIG. 8) made up of matrix elements to determine driver data DAT showing a voltage to be applied to a display section (electronic paper) from data on a previous screen and data on a renewed image. After the receipt of the frame number NUB, LUT data Lut corresponding to driving processing of a present frame is outputted to the LUT converting circuit 29. Moreover, the LUT data Lut for every frame is produced by the above LUT generating method and driving voltage waveforms for every gray level of a renewed screen using the LUT data Lut.

Operations of Circuits

Figure 12:
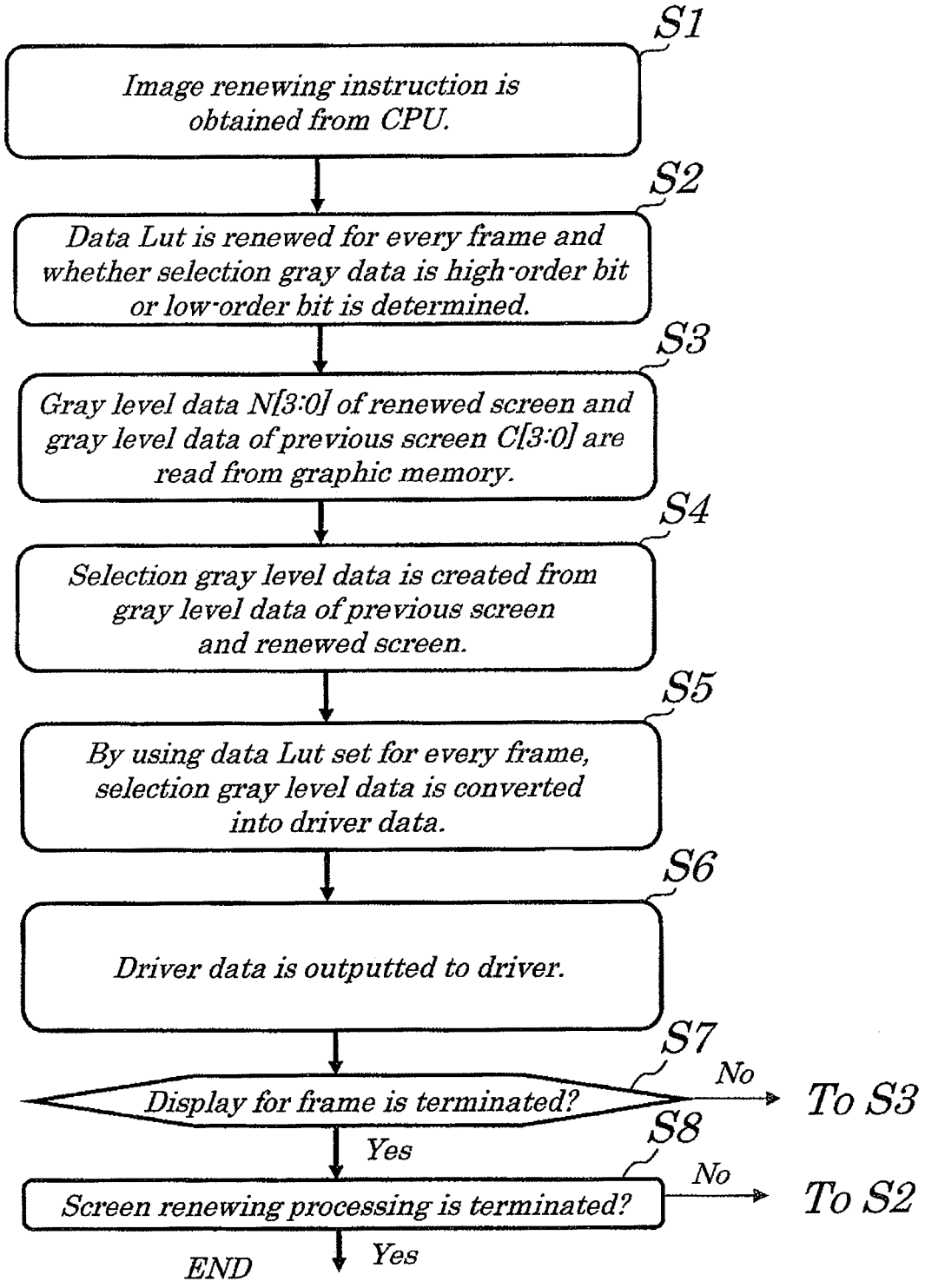
FIG. 12 is a flowchart diagrammatically showing a flow of an image renewing operation to be performed by the same electronic paper controller.
Figure 13A:
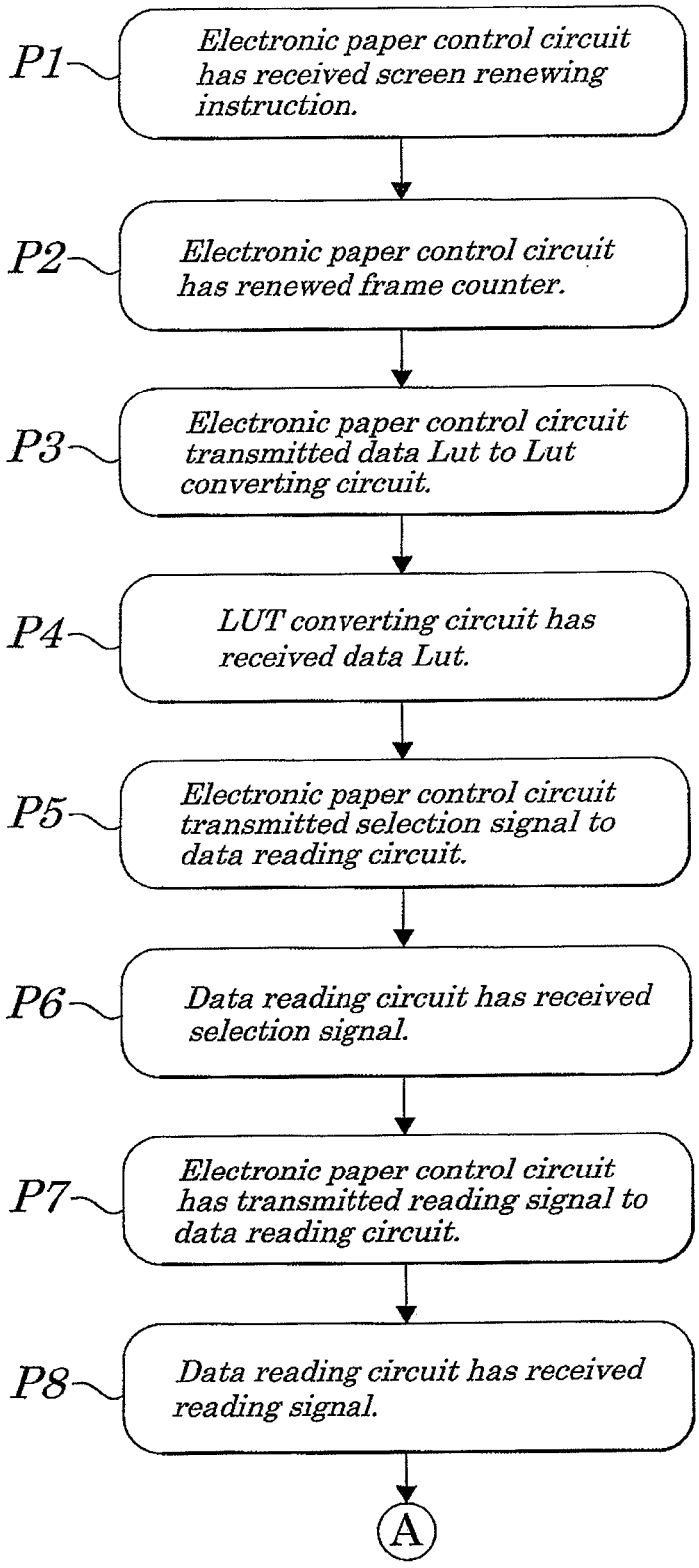
FIGS. 13A and 13B are flowcharts showing, in detail, a flow of the image renewing operation to be performed by the same electronic paper controller.
Figure 13B:
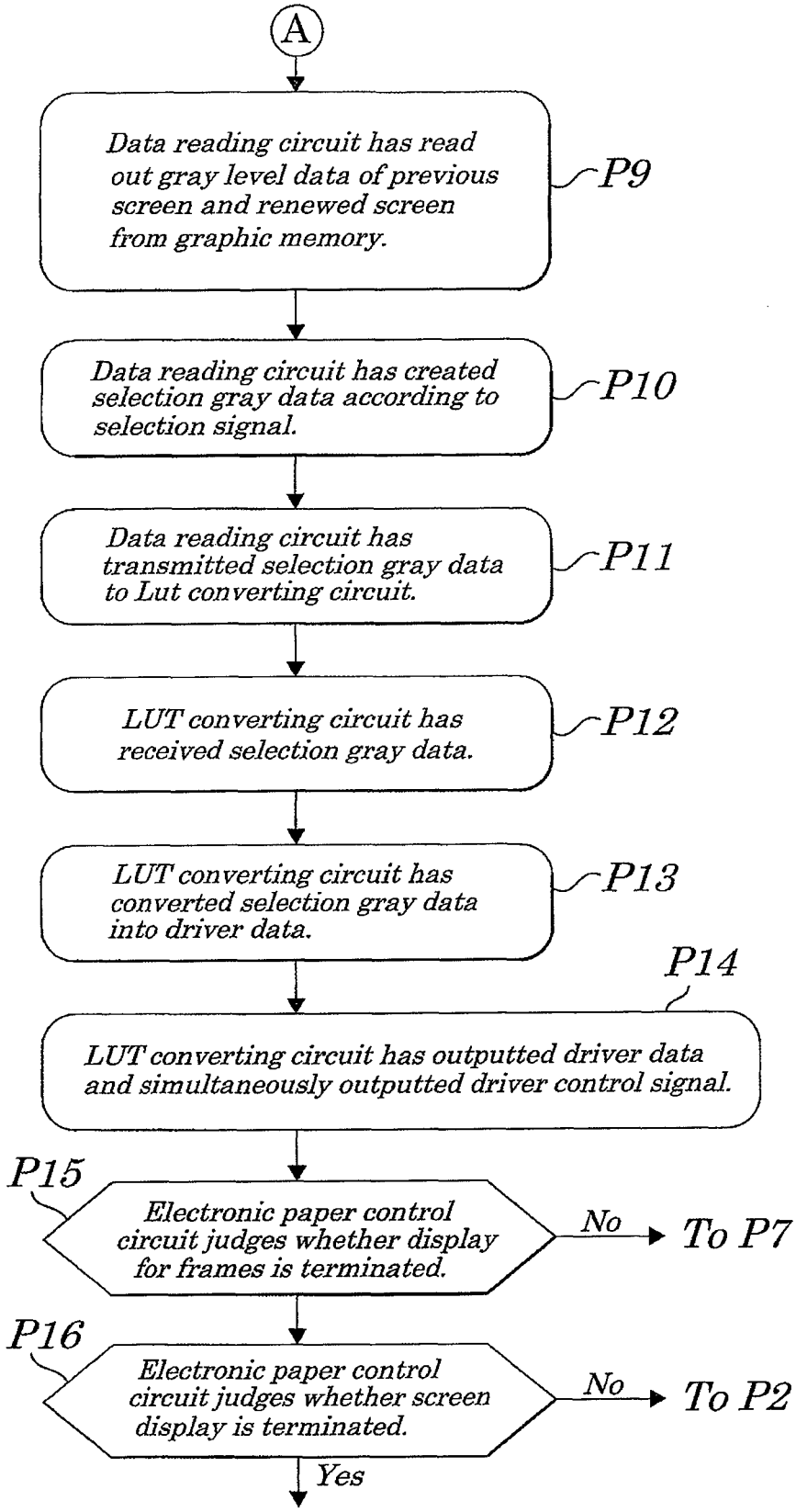

Next, by referring to FIGS. 12 and 13, operations of circuits of the above electronic paper controller 19 are described. FIG. 12 is a flowchart diagrammatically showing a flow of an image renewing operation to be performed by the electronic paper controller (see FIG. 7). FIGS. 13A and 13B are flowcharts showing, in detail, a flow of an image renewing operation to be performed by the electronic paper controller (see FIG. 8).

The operations of the electronic paper controller 19 are divided into image storing operations by which gray level data of a renewed screen is stored into the graphic memory 20 and image renewing operations by which image data stored in the graphic memory 20 is read and image display is performed. In the image storing operations, the electronic paper controller 19 (FIG. 7) stores 4-bit gray level data N[3:0] group inputted from, for example, the storage 23 or from the outside (through the data transmitting/receiving section 24) into the graphic memory 20.

The electronic paper controller 19, when receiving an image renewing instruction COM from the CPU 21 in a standby state (Step S1 in FIG. 12), proceeds to Step S2 and starts image renewing operations. The electronic paper controller 19 renews the LUT data Lut for every frame at the Step S2 and determines whether the selection gray level data CND is a high-order bit or a low-order bit of gray level data of a renewed screen. Next, the electronic paper controller 19 reads gray level data N[3:0] of a renewed image and gray level data C[3:0] of a previous screen from the graphic memory 20 (Step S3).

Then, the electronic paper controller 19 creates selection gray-level data CND made up of high-order bit or low-order bit gray-level data of a renewed screen and gray level data (in the example, remaining 4 bits) of a previous screen from a read gray data N[3:0] and C[3:0] according to the determination of selection at Step S2 (Step S4).

Next, by referring to the LUT prepared at the Step S2 (for example FIG. 6), selection gray-level data CND is converted into driver data DAT (Step S5). Then, the driver data DAT is outputted to the data driver 18 (Step S6).

Thereafter, at Step S7, the electronic paper controller 19 judges whether or not the process of displaying with the employed frame has been terminated and, when it is judged that the process has not been terminated, returns back to the Step S3, and reads gray level data N[3:0] of a subsequent pixel making up a renewed screen from the graphic memory 20 and gray level C[3:0] of a previous screen to repeat the above operating processes. On the other hand, as a result of the judgment at the Step S7, when the process of displaying with the frame has been terminated, the electronic paper controller 19 proceeds to Step S8 and judges whether or not the screen renewing process is terminated. When it is judged that the screen renewing processing is not terminated at Step S8, the electronic paper controller 19 returns back to the Step S2 and renews the LUT data Lut to determine whether selection gray-level data for a next frame is the high-order bit or low-bit order of the gray level of a renewed screen (thereafter, the above processing is repeated). On the other hand, as a result of the judgment at the Step S8, when the screen renewing process is terminated, the series of operations are terminated.

Next, by referring to FIGS. 13A and 13B, the screen renewing operations of the electronic paper controller 19 (see FIG. 8) are described in detail.

The electronic paper controller 19, when receiving a screen renewing instruction COM, in a standby state (Step P1 in FIG. 13A), the image renewing operations are started. The electronic paper control circuit 27 renews the frame counter 31 (Step P2) and transmits LUT data Lut to the LUT converting circuit 29 (Step P3) and the LUT converting circuit 29 receives the LUT data Lut from the electronic paper control circuit 27 (Step P4).

Further, the electronic paper control circuit 27 transmits selection signal SEL to determine whether selection gray-level data is high-order bit or low-order bit of the gray level data of a renewed screen to the data reading circuit 28 (Step P5). The data reading circuit 28 receives the selection signal SEL from the electronic paper control circuit 27 (Step P6). Thus, the setting operations at the time of frame renewal is terminated, which starts the process of converting gray-level data of a pixel and of outputting data to the data driver 18.

First, the electronic paper control circuit 27 transmits a request signal REQ requesting for reading of gray level data to the data reading circuit 28 (Step P7). The data reading circuit 28 receives the reading signal REQ (Step P8). The data receiving circuit 28, when receiving the reading signal REQ, accesses to the graphic memory 20 to read out gray level data of a previous screen and a renewed screen (Step P9 in FIG. 13B).

The data reading circuit 28, when obtaining gray level data of a previous screen and a renewed screen from the graphic memory 20, creates selection gray-level data CND made up of high-order bit or low-order gray data of a renewed screen and of a previous screen (in this example, remaining 4 bits) according to the selection signal SEL received at Step P6 (Step P10). The data reading circuit 28 transmits created selection gray-level data CND to the LUT converting circuit (Step P11). The LUT converting circuit 29, when receiving selection gray-level data from the data reading circuit 28 (Step P12), converts selection gray level data CND to the driver data DAT (Step P13) according to the LUT data Lut received at Step P4.

Next, the LUT converting circuit 29 outputs driver data DAT to the data driver 18. In synchronization with the outputting process, the electronic paper control circuit 27 outputs the driver control signal CTL to the gate driver 17 and data driver 18 (Step P14).

Thereafter, at Step P15, the electronic paper control circuit 27 judges whether or not the process of displaying with the used frame and, when the result of judgment is negative, returns back to Step P7 and reads gray data N[3:0] of a subsequent pixel and gray data C[3:0] of a previous screen making up a renewed screen from the graphic memory 20 to repeat the processing of above operations. As the result of the judgment at the Step P15, when the process of displaying with the frame is terminated, the electronic paper control circuit proceeds to Step P16 and judges whether or not the screen renewal processing is terminated.

At the Step P16, whether or not the frame number NUB exceeds the number of frames (in the example of methods of generating and converting the LUT, the number is 91 frames) is judged (Step P16) and, as the result of the judgment, when the frame number NUB exceeds the number of frames, the image renewal processing is terminated and, when the frame number NUB does not exceed the number of frames, the electronic paper control circuit 27 returns back to the Step P2 and, after counting up frames, the above-described operations are repeated.

Next, the method of converting data from selection gray-level data CND to driver data DAT is described more specifiedally. Here, it is supposed that, for circuit configurations to achieve driving voltage waveforms in FIGS. 2(1) to 5(16), the LUT group WFn(n=1 to 91) in Table 2 is used. Also, it is suggested that, for simplification, a previous screen [0000] is solidly shaded displayed and a renewed screen is displayed with an intermediate gray level of 6 [0110] and an operation is performed for a period of time corresponding to the 70th frame (high-order bit display period).

In the example, gray level data of a previous screen is set to be C[3:0]=[0000] and gray level data of a renewed screen is to be N[3:0]=[0110]. The 70th frame time is the high-order bit display period and, therefore, the selection signal SEL inputted into the data reading circuit 28 from the electronic paper control circuit 27 indicates a high-order bit selection (U), thereby creating selection gray-level data CND cut for the high-order bit.

That is, the selection gray-level data CND shows that C[3:0]N[3:2]=[0000-01]. Then, the LUT for the 70th frame supplied as LUT data Lut from the electronic paper control circuit 27 is stored in a register for LUT of the LUT converting circuit 29. In the example, the gray-level data C[3:0] is not referenced to and, therefore, the LUT is data on the 4-th row and 1st column and WF70(00)=[10], WF70(01)=[10], WF70 (10)=[00], WF70 (11)=[00].

Here, N[3:2]=[01] and, therefore, by the LUT conversion, data WF70 (N[3:2])=WF70(01)=[10] (=+15V) is outputted as driver data DAT.

Next, operations for a period of time corresponding to the 85th frame are described. The period of time corresponding to 85th frame is in the low-order bit displaying period and, therefore, the selection signal SEL provides an instruction for selection of the low-order bit selection (D) (see Table 2) and the selection gray-level data CND cut for the low-order bit is created. That is, the selection gray-level data is set to be C[3:0]N[1:0]=[0000-10]. In the register for the LUT of the LUT converting circuit 29, 85th frame LUT supplied as the LUT data Lut from the electronic paper control circuit 27 is stored. In the example, a previous screen data C[3:0] is not referenced to and, therefore, the LUT is the data on the 4th row and 1st column which is WF85 (00)=[10], WF85 (10)=[10], WF85 (11)=[00]. Here, N[1:0]=[10] and, therefore, by LUT conversion, WF85(N[1:0]=WF85 (10)=[10] (=+15V) is outputted as driver data DAT.

According to the driving method of the exemplary embodiment, during the high-order bit displaying period, after display with coarse gray levels of 4 or so is performed and during the next low-order displaying period, display with image gray levels that gradually become finer and, therefore, even at time of switching of a screen, image display giving less abnormal feelings is made possible.

Also, in the conventional driving method, when input image data is displayed with 16 gray levels (4 bits) and with the number of driving frames of 91 to be applied at the time of renewing, 1456 (16×1×91) pieces of matrix data is required. In the present exemplary embodiment, data is made up of 4×1 LUT data and, therefore, the number of matrix data required for display is only 364 (4×1×91) pieces of matrix data, thus enabling matrix data to be deleted. As a result, the LUT adjustment to obtain appropriate image is made easy, thus achieving the improvement of image display quality.

Second Exemplary Embodiment

Next, an electronic paper display device and a method of driving the same according to the second exemplary embodiment of the present invention are described.

Figure 14:
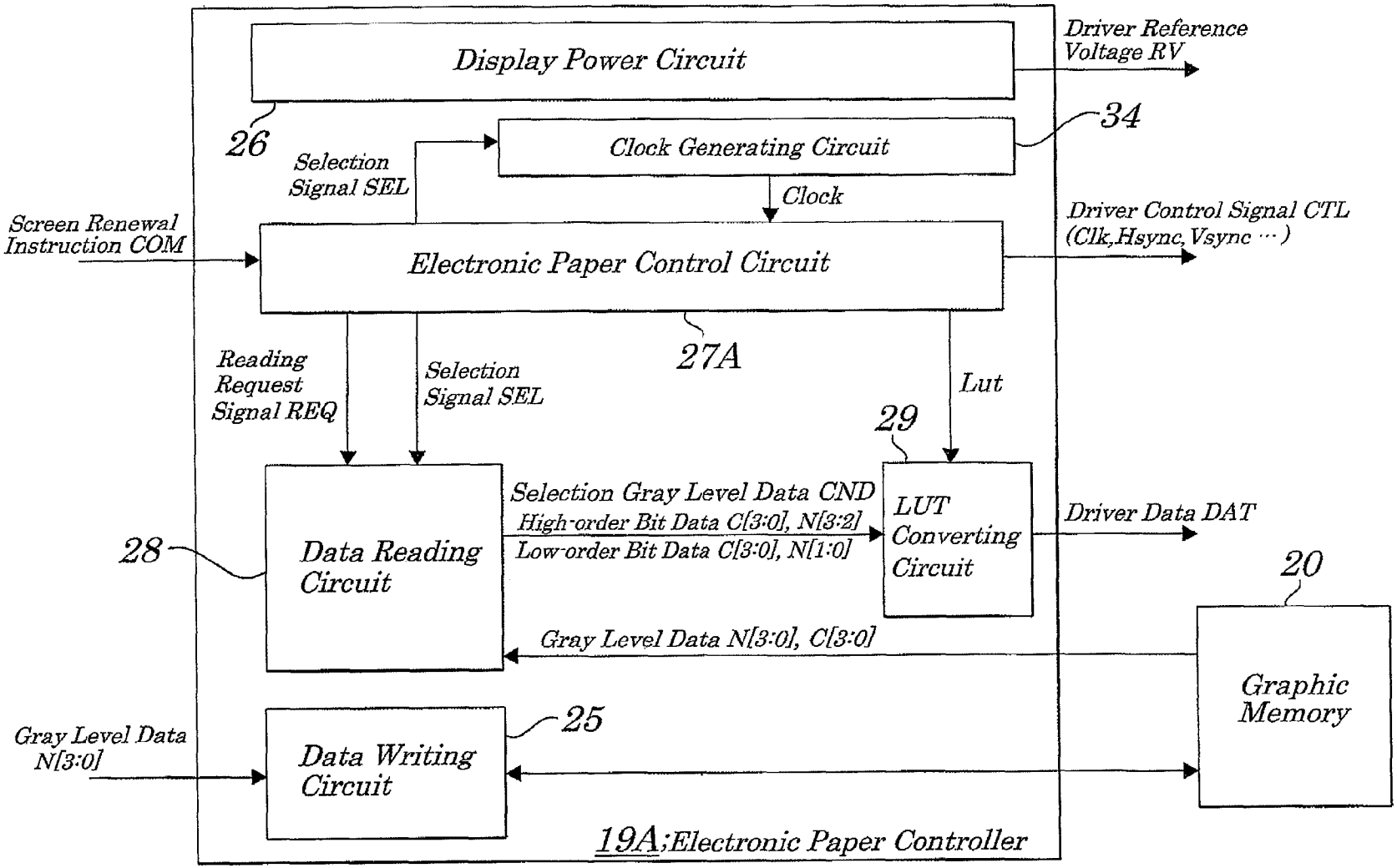
FIG. 14 is a block diagram showing electrical configurations of an electronic paper controller making up an electronic paper display device according to a second exemplary embodiment of the present invention.

FIG. 14 is a block diagram for showing electrical configurations of an electronic paper controller making up the electronic paper display device of the second exemplary embodiment.

The electronic paper controller 19A includes, as shown in FIG. 14, a data writing circuit 25, a display power circuit 26, an electronic paper control circuit 27A, a data reading circuit 28, an LUT converting circuit 29, and a clock generating circuit 34.

The configurations of the display device of the second exemplary embodiment differ greatly from those of the first exemplary embodiment only in that the clock generating circuit 34 is mounted which changes a frame frequency in the high-order bit displaying period and a frame frequency in the low-order bit displaying period. In FIG. 14, the same reference numbers are assigned to each component having the same functions as in the first exemplary embodiment (FIG. 8) and their descriptions are not described or simplified accordingly.

In the above configurations, by setting a frame frequency for the resetting period and high-order bit displaying period to be 15 Hz and the number of frames for the low-order bit to be 30 Hz, the number of LUT data can be reduced to 25 pieces (=15+6+3+1) (15 denotes the number of frames for the resetting period, 6 denotes the number of frames for the high-order displaying period, 3 denotes the number of frames for the low-order displaying period, and 1 denotes the number of 0V frames. As a result, the number of LUT data can be reduced in a manner to correspond to the number of frames required for driving the device. Additionally, the frame frequency is made low, thereby deleting power consumption.

Third Embodiment

Next, an electronic paper display device and its driving method according to the third exemplary embodiment of the present invention are described.

Driving Method

Figure 15:
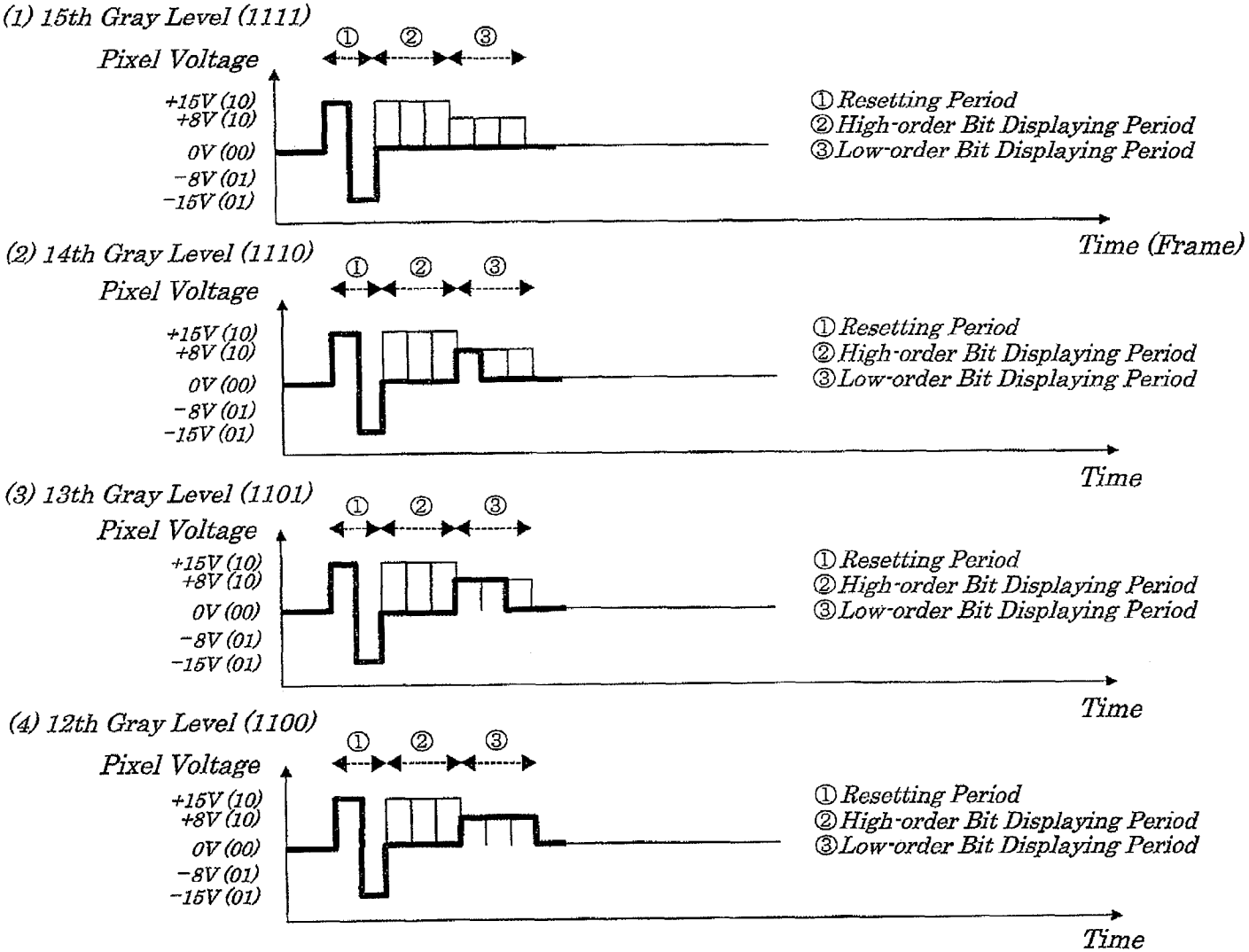
FIGS. 15(1) to 15(4) are diagrams provided to explain a driving method of an electronic paper display device according to a third exemplary embodiment of the present invention and waveform diagrams (1) to (4) showing driving voltage waveforms to be applied to a pixel electrode for every gray level in input gray level data.

FIGS. 15(1) to 18(16) are diagrams provided to explain the driving method of the electronic paper display device of the third exemplary embodiment showing the driving voltage waveform to be applied to pixel electrodes for every gray level.

The driving method of the third exemplary embodiment is common to the driving method of the first exemplary embodiment (FIG. 1) in that a method of renewing a specified image by driving the device for a period of time corresponding to a plurality of frames. Multiple gray level display is realized by dividing a renewing period into a high-order bit displaying period and a low-order bit displaying period and by sequential driving the device for renewal of a screen.

However, the electronic paper display device and driving method of the third exemplary embodiment differ greatly from the driving method of the first exemplary embodiment in that the device has an electrophoretic display element with an excellent response property and in that high speed renewal driving is performed by setting a reference voltage to be high during a high-order bit displaying period and low speed renewal driving is performed by setting a reference voltage to be low during a low-order bit displaying period.

The electrophoretic display element has a property of the response speed of, for example, 125 ms for driving at 15V and the response speed of 500 ms for driving at 8V occurring when white display is renewed to be black display.

That is, according to the third exemplary embodiment, by setting the reference voltages of +Vd, 0V, and −Vd to be applied during the low-order bit displaying period to be lower than the voltages +Vu, 0V, and −Vu (for example, Vd=8V and Vu=15V) to be applied during the high-order bit displaying period and by decreasing the response speed of the electrophoretic display element only in the low-bit displaying period, very fine and minute gray level control can be realized without raising a frame frequency.

Also, according to the third exemplary embodiment, by decreasing a response speed of the electrophoretic display element only during the low-order bit displaying period and, during a black and white resetting period and a high-order bit displaying period, a response speed of the electrophoretic display element is made high and, therefore, renewal time for a screen can be shortened, as a whole, compared with that applied in the first exemplary embodiment.

First, an example of displaying a gradation image with 16 gray levels is shown as a renewal image in which an image is displayed with 4 gray levels (coarse gray level) during the high-bit order displaying period and, during the low-order bit displaying period, each of the gray levels is divided into 4 gray levels (fine gray levels). Moreover, the description is made by using a reset driving method in which a history of a previous screen is deleted by displaying a black and white resetting screen irrespective of the previous screen.

First, the black and white resetting process is performed by deleting traces of the previous image. In the black and white resetting process, a voltage of +15V is continuously applied for a period of time corresponding to a response speed of the electrophoretic display element to display a black (FIGS. 15(1) to 18(16)). In the device of the exemplary embodiment, if the frame frequency is set to be 60 Hz, black is displayed by applying a voltage of +15V to the electrophoretic displaying device for a period of time corresponding to 7.5 (=0.125 sec×60 Hz) frames. Following this, a screen is changed from black display to white display by continuously applying a voltage of −15V for a period of time corresponding to 7.5 frames (FIGS. 15(1) to 18(16)). Here, there are fractions in the number of frames and, therefore, 8 frames are used for both the black display and white display. The display luminance of black and white is saturated and, therefore, the luminance of white remains unchanged even by the excessive application of a voltage for a period of time corresponding to about 0.5 frames, which causes no harm.

Next, an image is displayed with multiple gray levels during the high-order bit displaying period (coarse gray level display period) and the low-order bit displaying period (fine gray level display period) in a separate manner. In the case of coarse gray level display, based on gray level data (input gray level data) for each pixel of a gradation image, when gray level data in the range of 0th to 3rd gray levels is inputted during the high-order bit displaying period, corresponding pixels are uniformly displayed with the 3rd gray level and, when gray level data in the range of 4th to 7th gray levels is inputted during the above period, corresponding pixels are uniformly displayed with the 7th gray level, and when gray level data in the range of 8th to 11th gray levels is inputted during the above period, corresponding pixels are uniformly displayed with the 11th gray level, and when gray level data in the range of 12th to 15th gray levels is inputted during the above period, corresponding pixels are uniformly displayed with the 15 gray level (see Table 3).

Such display of the coarse gray level can be realized by applying voltages for a period of time corresponding to 6 frames in the high-order bit displaying period. The reason for this is that the gray level is changed from white to black for 6 frame time and, therefore, the number of frames required for gray level change from white (15th gray level) to the 3rd gray level (maximum gray level change for coarse gray level) is 6 ([15−3]/[15−0]×7.5).

In the first exemplary embodiment, as described above, the high-order bit displaying period for 24 frames is required to perform coarse gray level display, however, in the third exemplary embodiment, 6 frames (¼ of 24 frames) are sufficient. The reason for this is that the response speed of the electrophoretic display device of the third exemplary embodiment (125 ms for driving at 15V) is superior to that in the first exemplary embodiment (500 ms for driving at 15V) (see Tables 1 and 3).

Figure 16:
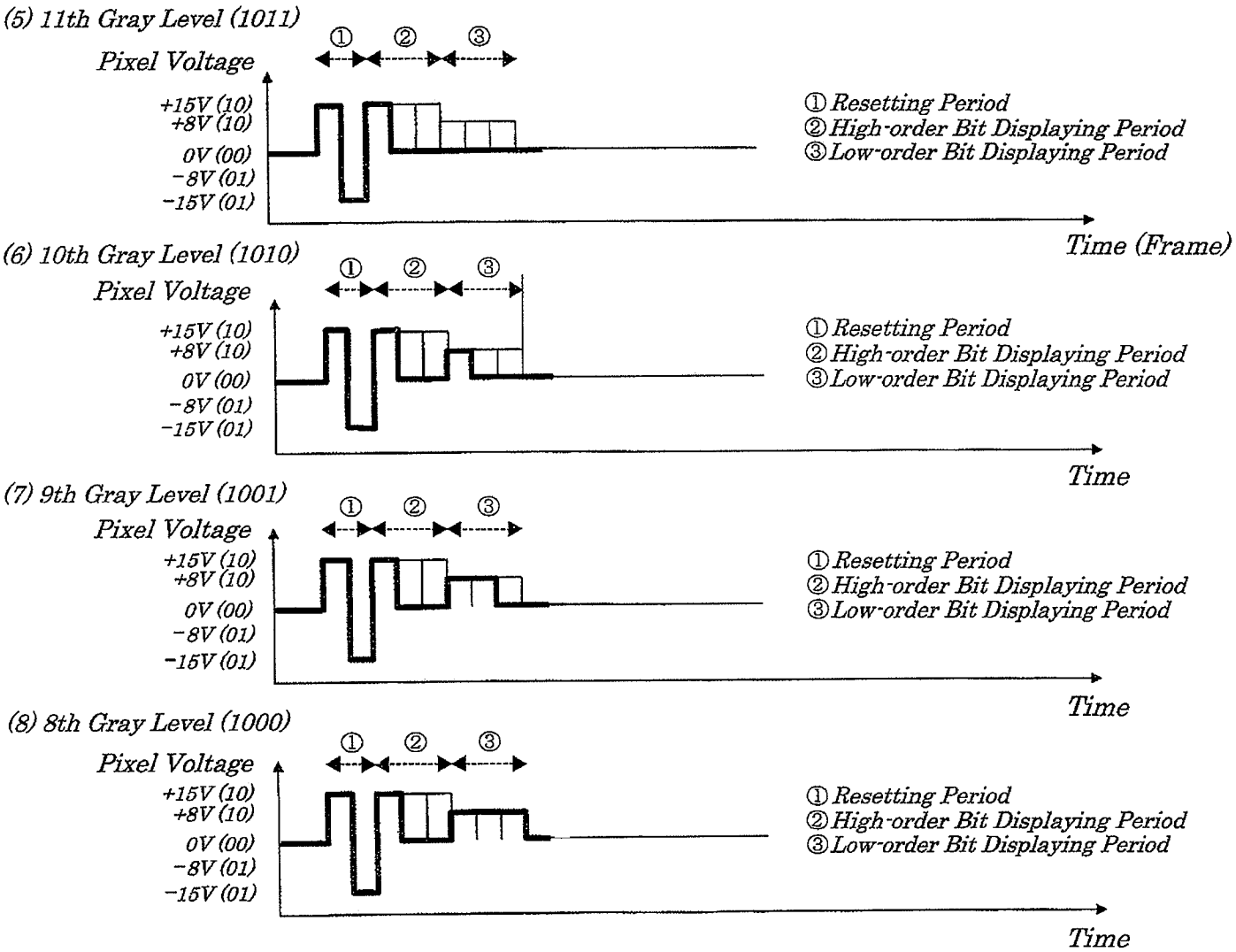
FIGS. 16(5) to 16(8) are diagrams provided to explain the driving method of the same electronic paper display device and waveform diagrams (5) to (8) showing driving voltage waveforms to be applied to the pixel electrode for every gray level in input gray level data.
Figure 17:
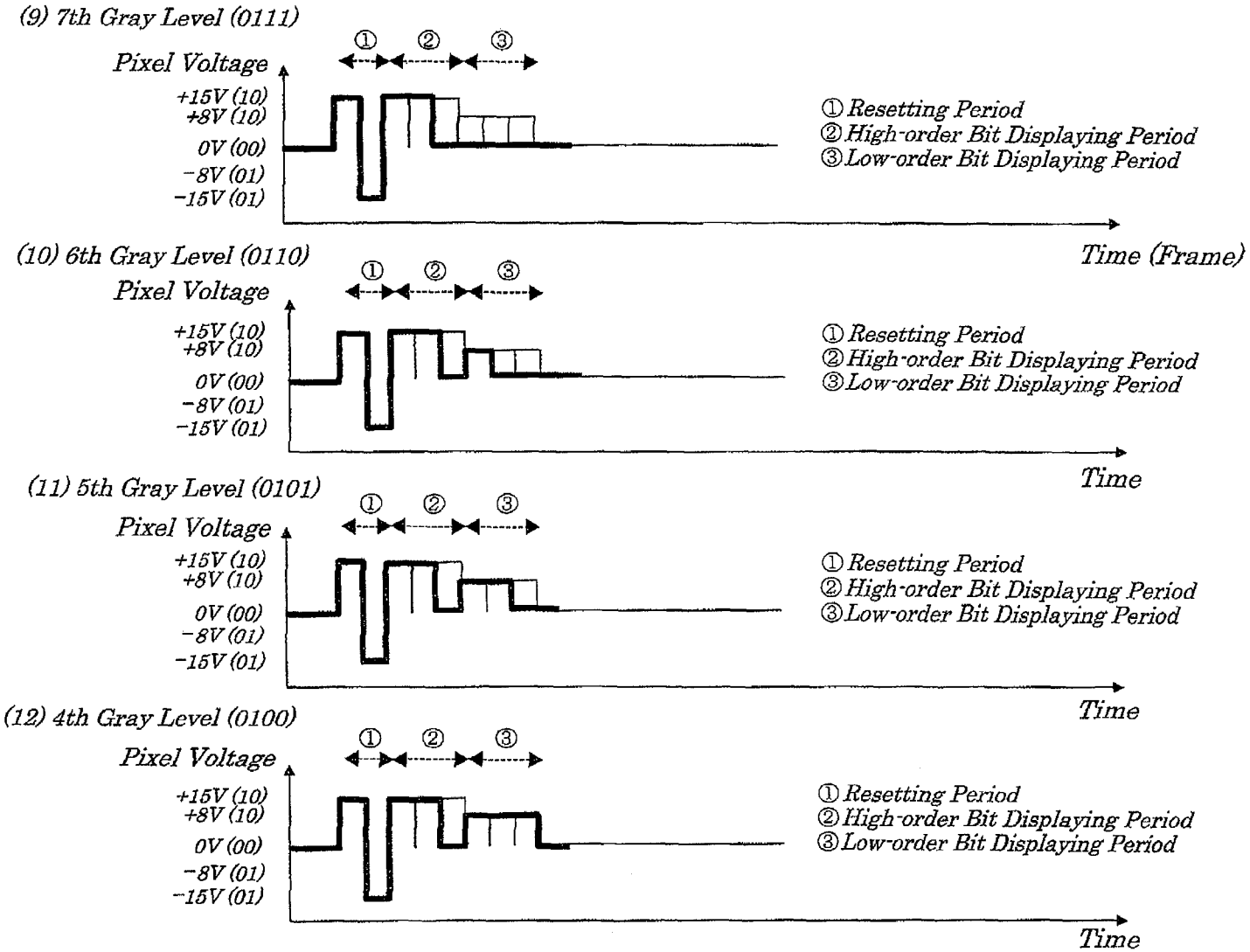
FIGS. 17(9) to 17(12) are diagram provided to explain the driving method of the same electronic paper display device and waveform diagrams (9) to (12) showing driving voltage waveforms to be applied to the pixel electrode for every gray level in input gray level data.

More specifiedally, a voltage of 0V corresponding to 6 frames is applied to the pixel electrode corresponding to 12th to 15th gray level data (FIGS. 15(1) to 15(4) and Table 3). As a result, the corresponding pixel continues to display white (with 15th gray level) during the high-order bit displaying period. Next, a voltage of +15V corresponding to 2 frames and then a voltage of 0V corresponding to remaining 4 frames is applied to the pixel electrode corresponding to 8th to 11th gray level data (FIGS. 16(5) to 16(8), Table 3). This causes the corresponding pixel to have luminance of 11th gray level. A voltage of +15V is applied for a period of time corresponding to 4 frames to the pixel electrode corresponding to 4th to 7th gray level data (FIGS. 17(9) to 17(12) and Table 3). This causes the corresponding pixel to have luminance of 7th gray level.

Figure 18:
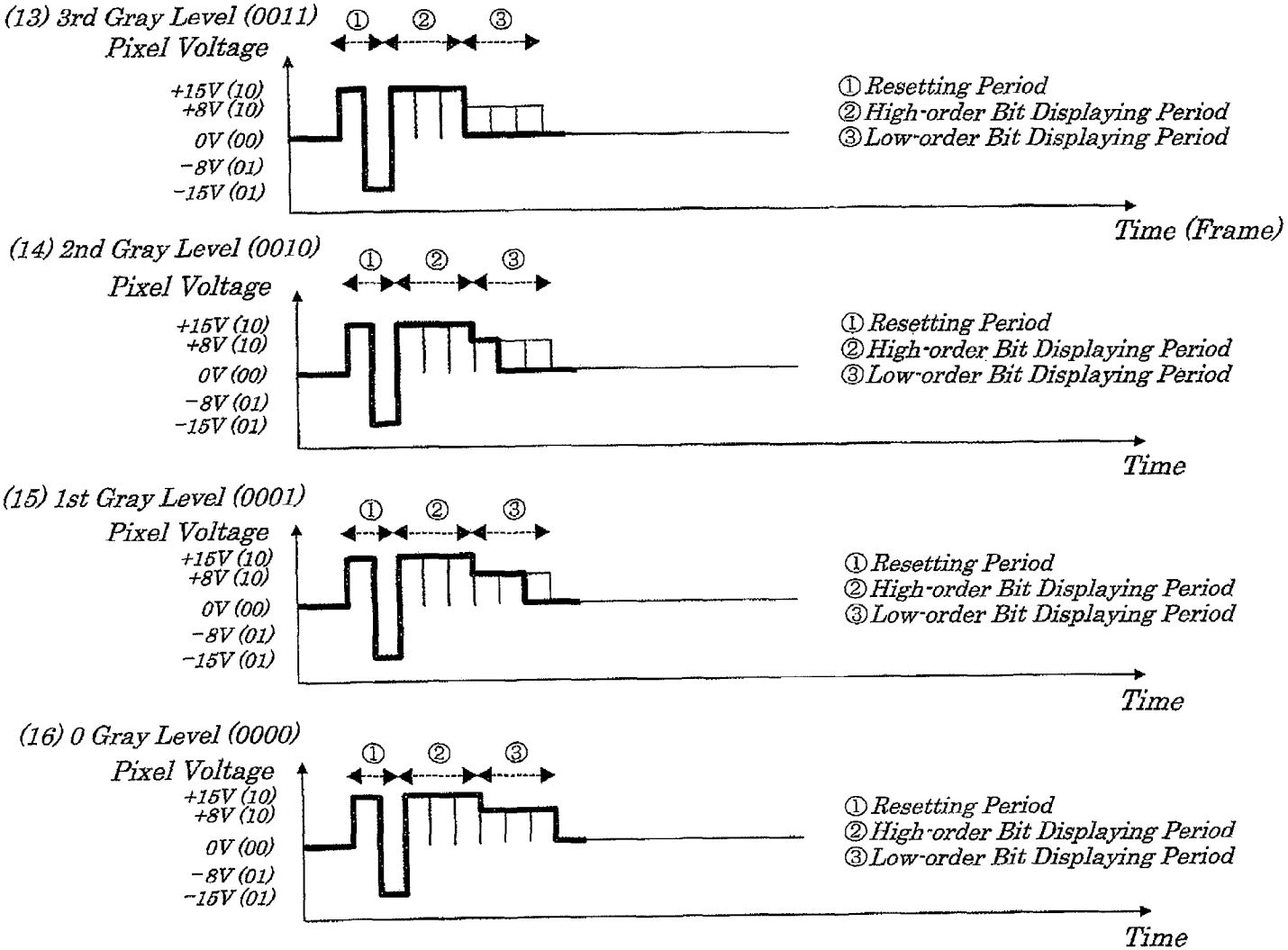
FIGS. 18(13) to (16) are diagrams provided to explain the driving method of the same electronic paper display device and waveform diagrams (13) to (16) showing driving voltage waveforms to be applied to the pixel electrode for every gray level in input gray level data.

Then, a voltage of +15V is applied for a period of time corresponding to 6 frames to the pixel electrode corresponding to the 0th to 3rd gray level data (FIGS. 18(13) to 18(16)). This causes the corresponding pixel to have luminance of the 3rd gray level. Thus, an image is displayed with the 3rd gray level according to the 0th to 3rd gray level input data, an image is displayed with the 7th gray level according to the 4th to 7th gray level input data, an image is displayed with the 11th gray level according to the 8th to 11th gray level data, and an image is displayed with 15 gray levels according to the 12 to 15 gray level data.

During the subsequent low-order bit displaying period, the separation (1) to fine gray levels; from the 3rd gray level (coarse gray level) to the 0th, 1st, 2nd, and 3rd gray levels, separation (2) to fine gray levels; from the 7th gray level (coarse gray level) to the 4th, 5th, 6th, and 7th gray levels, separation (3) to fine gray levels; from the 11th gray level (coarse gray level) to the 8th, 9th, 10, and 11th gray levels, and separation (4) to fine gray levels; from the 15th gray level (coarse gray level) to 12, 13, 14, and 15 gray levels, are simultaneously performed.

At this point of time, the reference voltage of the data driver is lowered to 8V and the response speed of the electrophoretic display element is reduced to 500 ms. As a result, the response speed of the electrophoretic display element becomes the same as that of the first exemplary embodiment and, therefore, time required for voltage application to the pixel electrode for the separation of each gray level becomes the same as that of the first exemplary embodiment (Table 1). Therefore, the low-order bit displaying period is 6 bits as in the case of the first exemplary embodiment.

Table 3 shows that a driving voltage waveform to be applied to the pixel electrode during the high-order bit displaying period is the same among input gray level data having the same high-order bit and a driving voltage waveform to be applied to the pixel electrode during the high-order bit displaying period is the same among input gray level data having the same low-order bit. Therefore, by selecting either of the high-order bit or low-order bit of the gray level of the input pixel data for every frame and by preparing the LUT to determine a driving voltage (Table 4), the driving voltage waveform shown in FIGS. 15(1) to 18(16) can be realized.

TABLE 3

| Gray level of input pixel | Gray level high-order 2 bits | Gray level low-order 2 bits | High-order bit displaying period V: voltage, F: Frame | Low-order bit displaying period V: Voltage F: Frame |
|---|---|---|---|---|
| 15 | 11 | 11 | 0 V6F | 0 V6F |
| 14 | 11 | 10 | Same as above | 0 V4F, +8 V2F |
| 13 | 11 | 01 | Same as above | 0 V2F, +8 V4F |
| 12 | 11 | 00 | Same as above | 8 V4F |
| 11 | 10 | 11 | 0 V4F, +15 V2F | 0 V6F |
| 10 | 10 | 10 | Same as above | 0 V4F, +8 V2F |
| 9 | 10 | 01 | Same as above | 0 V2F, +8 V4F |
| 8 | 10 | 00 | Same as above | +8 V2F |
| 7 | 01 | 11 | 0 V2F, +15 V4F | 0 V6F |
| 6 | 01 | 10 | Same as above | 0 V4F, +8 V2F |
| 5 | 01 | 01 | Same as above | 0 V2F, +8 V2F |
| 4 | 01 | 00 | Same as above | 0 V6F |
| 3 | 00 | 11 | +15 V6F | 0 V6F |
| 2 | 00 | 10 | Same as above | 0 V4F, +8 V2F |
| 1 | 00 | 00 | Same as above | 0 V2F, +8 V4F |
| 0 | 00 | 00 | Same as above | +8 V6F |

As is apparent from driving voltage waveforms shown in FIGS. 15(1) to 18(16) and from Table 3, in the exemplary embodiment, 16 frames are required during the black and white resetting period, 6 frames are required during the high-order bit displaying period and 6 frames are required during the low-order bit displaying period and, therefore, the image renewing period being a total sum of these periods is 28 frames (=0.47 sec.). This is ⅓ of the image renewing period (1.5 sec.) in the first exemplary embodiment. Thus, according to the third exemplary embodiment, the image renewing period can be shortened when compared with the case of the first exemplary embodiment.

LUT Creation and Conversion Method

In Table 4, LUT group WFn corresponding to driving voltage waveforms to be used in the third exemplary embodiment is shown. The LUT creation and conversion method of the third exemplary embodiment is the same as that in the first exemplary embodiment and its description is omitted accordingly.

TABLE 4

| Frame number | High-order bit (U), Low-order bit (D) | WFn(00) | WFn(01) | WFn(10) | WFn(11) |
|---|---|---|---|---|---|
| 1-8 | U | 10 | 10 | 10 | 10 |
| 9-16 | U | 01 | 01 | 01 | 01 |
| 17-18 | U | 10 | 10 | 10 | 00 |
| 19-20 | U | 10 | 10 | 00 | 00 |
| 21-22 | U | 10 | 00 | 00 | 00 |
| 23-24 | D | 10 | 10 | 10 | 00 |
| 25-26 | D | 10 | 10 | 00 | 00 |
| 27 | D | 10 | 00 | 00 | 00 |
| 28 | D | 00 | 00 | 00 | 00 |

Circuit Configuration

Figure 19:
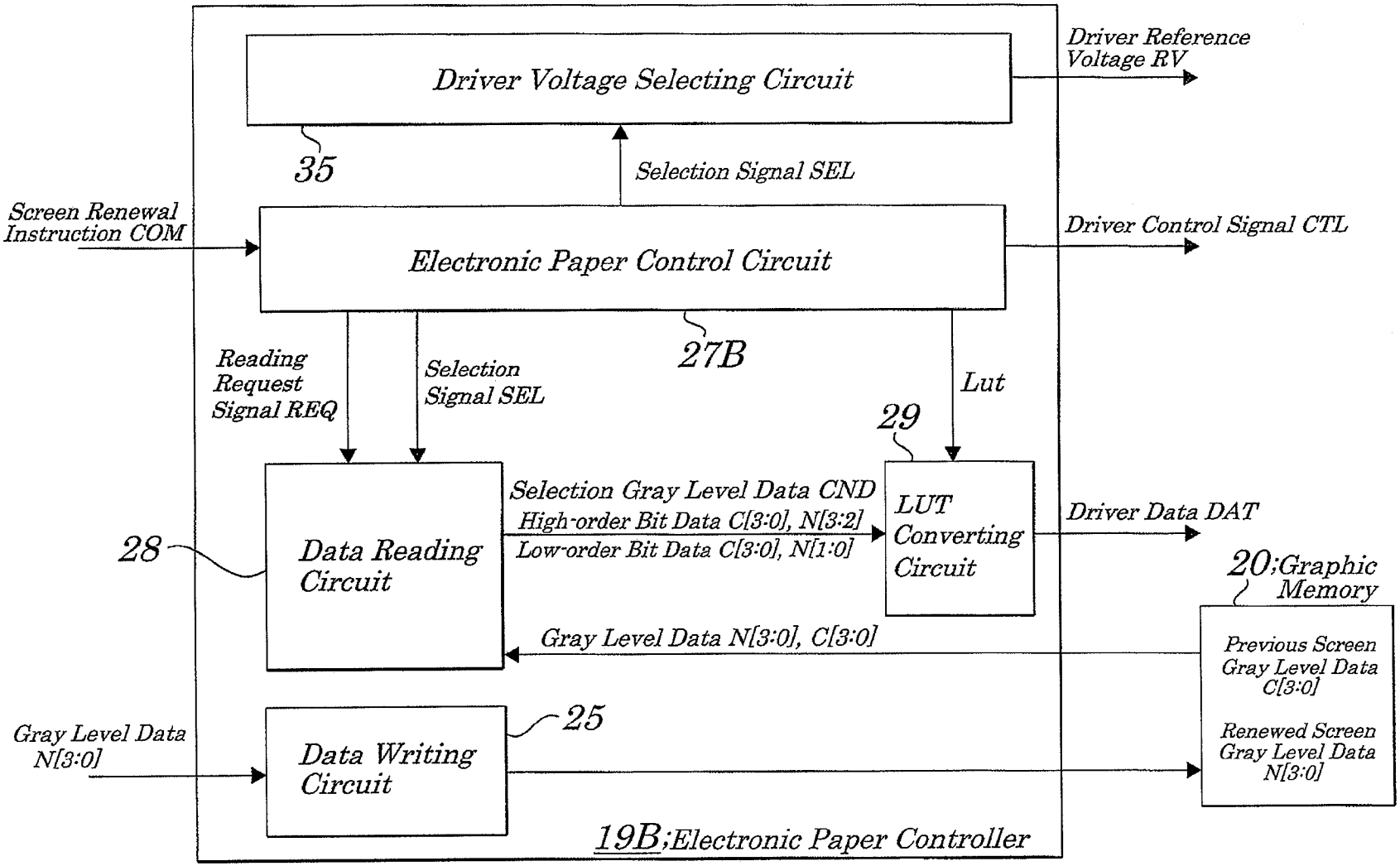
FIG. 19 is a block diagram showing electrical configurations of the same electronic paper controller making up the same electronic paper display device.

FIG. 19 is a block diagram for showing electrical configurations of an electronic paper controller making up an electronic paper display device of the third exemplary embodiment of the present invention.

The electronic paper controller 19B has a circuit configuration to realize a driving voltage waveform in FIGS. 15(1) to 18(16) by using LUT group data WFn shown in Table 4 and, more specifiedally, as shown in FIG. 19, is made up of a data writing circuit 25, an electronic paper control circuit 27B, a data reading circuit 28, an LUT converting circuit 29, and a driver voltage selecting circuit 35. The entire configurations of the electronic paper display device are almost the same as those in the first exemplary embodiment and, therefore, when necessary, are described by referring to FIG. 7. Moreover, in FIG. 19, same reference numbers are assigned to components being the same as those in the first exemplary embodiment and their descriptions are omitted accordingly.

The electronic paper control circuit 27B, when receiving a screen renewal instruction COM from a CPU, generates and outputs a selection signal SEL, a gray level data reading request signal REQ, and LUT data Lut. The above control signal CTL includes a clock Clk, a horizontal sync signal Hsync, and a vertical sync signal Vsync and is inputted to a gate driver 17 and data driver 18 of the electronic paper section 14 (see FIG. 7).

Moreover, the above selection signal SEL is a signal showing either of the high-order bit or low-order bit of gray level data for every frame and is inputted into the data reading circuit 28 and driver voltage selecting circuit 35. The gray level data reading request signal REQ is generated for every clock (for every pixel) and is inputted into the data reading circuit 28. The above LUT data Lut is an LUT to determine driver data DAT showing a voltage value to be applied to a display section 16 of the electronic paper section 14 (FIG. 7), which is realized by an LUT creating method and is supplied to the LUT converting circuit 29 for every frame.

The driver voltage selecting circuit 35 selects and determines a reference voltage RV to be applied to the data driver 18 (FIG. 7) for every frame according to the selection signal SEL to be received for every frame. For example, when the selection of the high-order bit is designated by the selection signal SEL, since the high-order bit is displayed in the high-order bit displaying period, the voltage of Vu (+15V, 0V, −15V) is determined as a reference voltage RV and is supplied to the data driver 18 and, when the selection of the low-order bit is designated by the selection signal SEL, since the low-order bit is displayed during the low-order bit displaying period, voltages of +8V, 0V, and −8V are determined as the reference voltage RV which are supplied to the data driver 18. Here, the selection signal SEL is set so that the selection of the high-order bit is designated even during the resetting period and, therefore, the voltage Vu (+15V, 0V, and −15V) is determined as a reference voltage RV and is supplied to the data driver 18. Moreover, instead of a reset signal, a signal being represented as a resetting period signal may be transmitted.

Operations of Circuits

Figure 20:
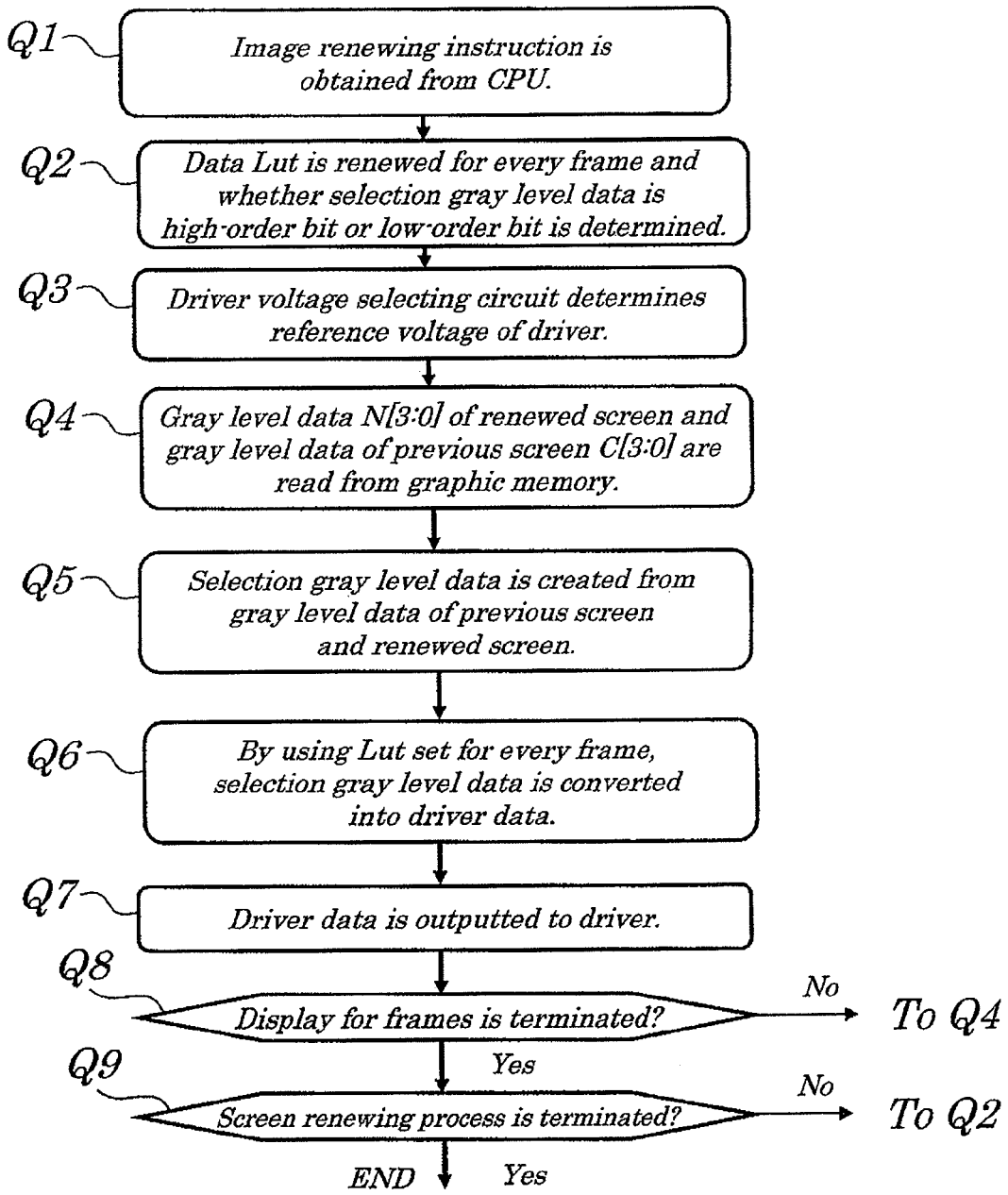
FIG. 20 is a flow chart diagrammatically showing a flow of an image renewing operation to be performed by the same electronic paper controller.
Figure 21:
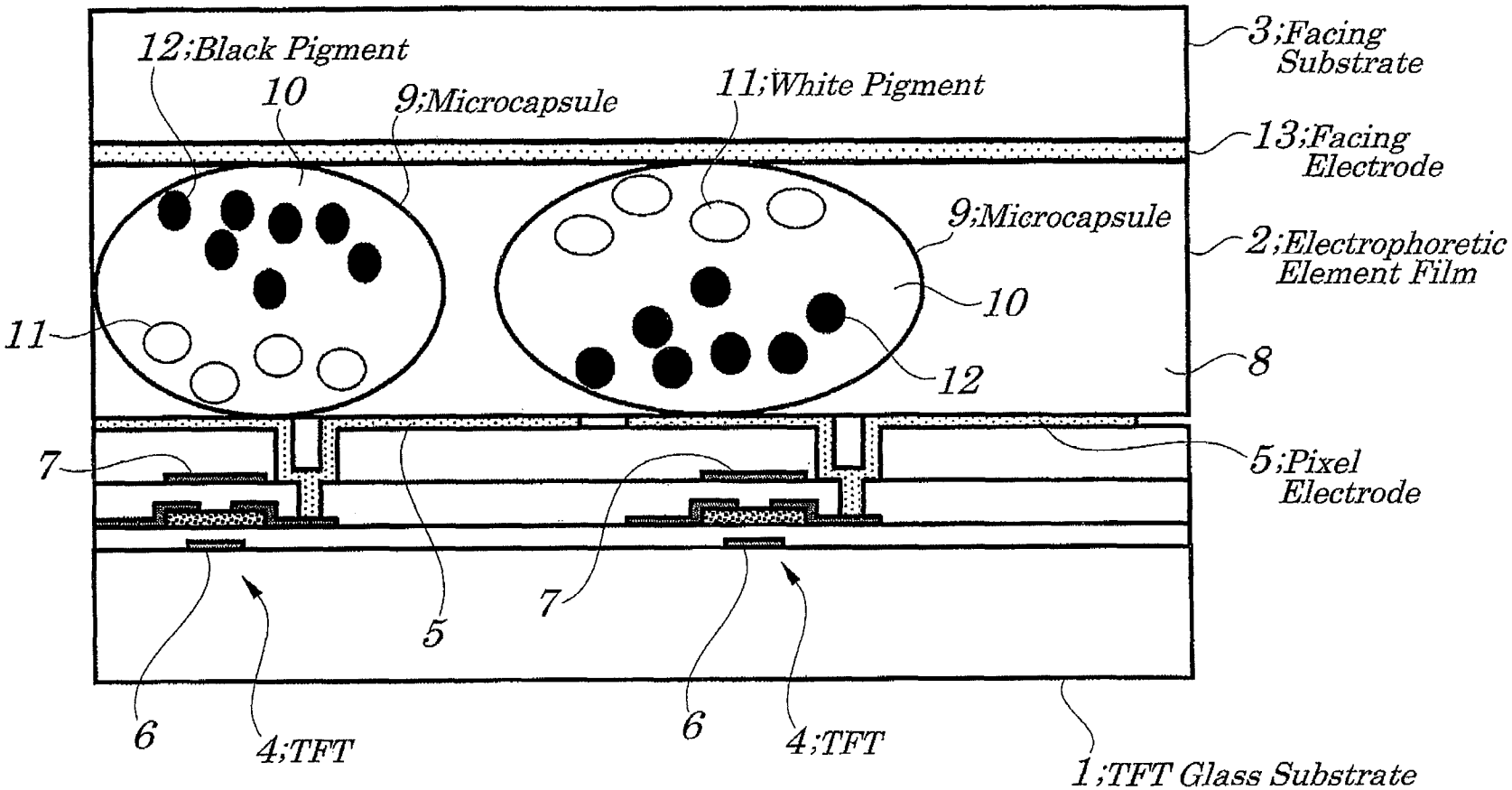
FIG.21 (RELATED ART)
FIG. 21 is a diagram to be used for explanation of a related art and is a partial cross-sectional view schematically showing a diagrammatic configuration of active matrix driving type electrophoretic display device.
Figure 22:
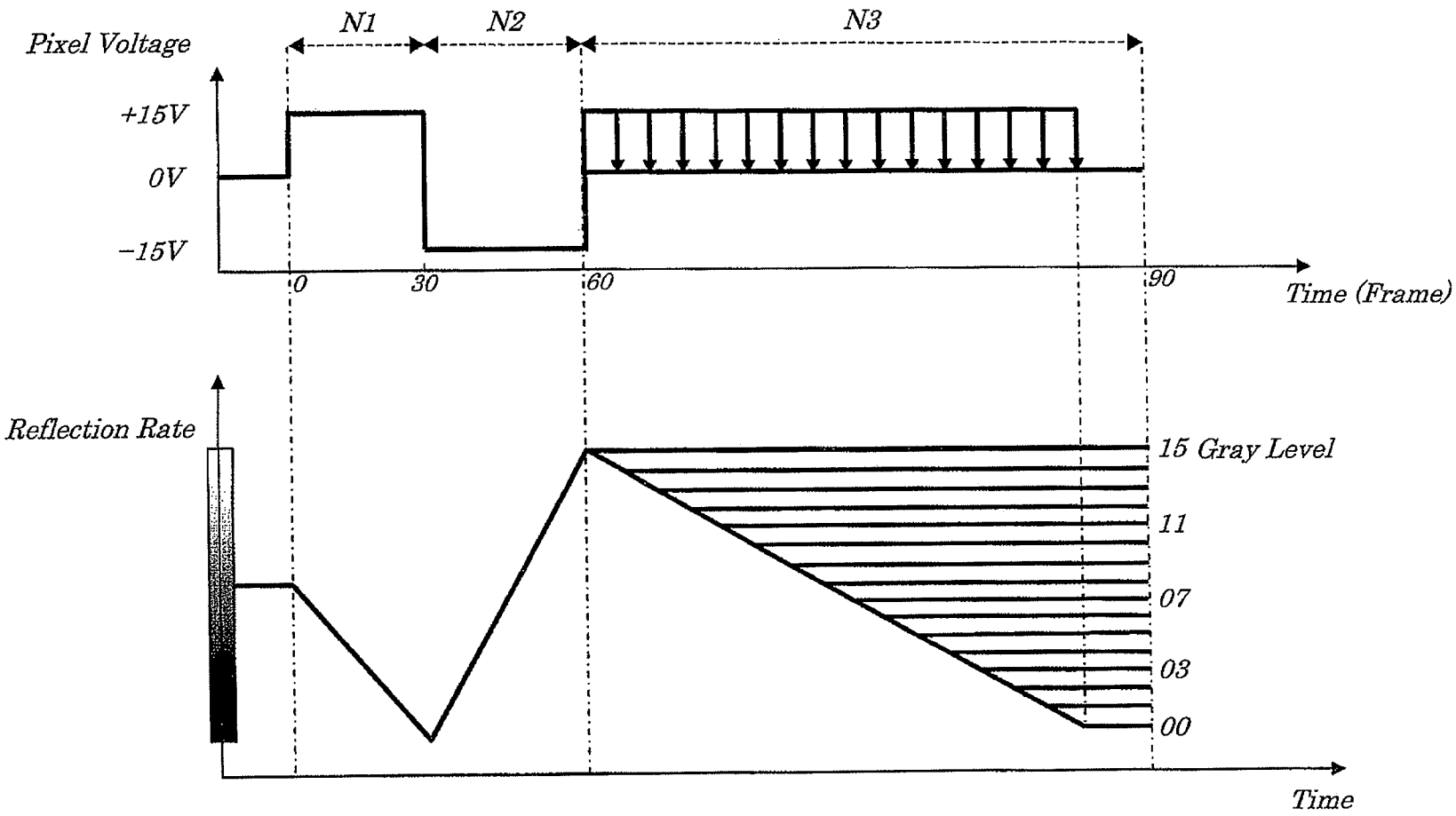
FIG.22 (RELATED ART)
FIG. 22 is a diagram to be used for explanation of the related art and shows an outline of a reset driving method.

Next, by referring to FIGS. 19 and 20, circuit configurations of the electronic paper controller 19B having the above configurations are described. FIG. 20 is a flow chart diagrammatically showing a flow of an image renewing operation to be performed by the electronic paper controller 19B (see FIG. 19).

The operation of the electronic paper controller 19B is made up of an image storing operation to store gray data of a renewed screen into the graphic memory 20 (see FIG. 7) and an image renewing operation to read image data stored in the graphic memory 20 and perform image display. In the image storing operation, the electronic paper controller 19B stores 4-bit gray data N[3:0] group of a renewed screen inputted from a storage 23 or from the outside (through a data transmitting/receiving section 24) into the graphic memory 20.

The electronic paper controller 19B, when receiving the image renewing instruction COM from the CPU 21 in a standby state (Step Q1 in FIG. 20), proceeds to Step Q2 and starts an image renewing operation. The electronic paper controller 19B renews LUT data Lut for every frame at Step Q2 and determines whether selection gray data CND is a high-order bit or low-order bit of gray level data of the renewed screen.

Next, the electronic paper controller 19B determines whether the reference voltage RV of the data driver 18 is used as a reference voltage for a high-order bit or a reference voltage for a low-order bit (Step Q3) to output the voltage. More specifiedally, the driver voltage selection circuit 35 receives a selection signal transmitted from the electronic paper control circuit 27B and the reference voltage RV of the data driver 18 is determined according to the selection signal SEL for outputting (Step Q3).

Next, the electronic paper controller 19B reads gray level data N[3:0] of a renewed screen and gray level data C [3:0] of a previous screen (Step Q4) from the graphic memory 20.

Next, the electronic paper controller 19B creates selection gray data CND using the read gray level data N[3:0] and C[3:0], high-order bit or low-order bit gray level data of a renewed screen, and gray level data of a previous screen (in the example, still being 4 bits) according to selection determination at Step Q2 (Step Q5).

Next, selection gray level data CND is converted into driver data DAT by referring to LUT set at Step Q2 (Step Q6). Then, the driver data DAT is outputted to the data driver 18 (Step Q7).

Thereafter, at Step Q8, the electronic paper controller 19B judges whether or not display processing for the frame is terminated and, when the result of the judgment is negative, returns back to Step Q4 and reads gray level data N[3:0] of a subsequent pixel making up a renewed screen and gray level data C[3:0] of a previous screen from the graphic memory 20 to repeat the above operations. On the other hand, when the result of the judgment at Step Q8 shows that display processing for the frame has been terminated, the electronic paper controller 19B proceeds to Step Q9 and judges whether or not the screen renewing processing is terminated. If the result from the judgment at Step Q9 is negative, the electronic paper controller 19B returns back to Step Q2 and renews LUT data Lut and determines which is used a high-order bit of gray level of a renewed screen or low-order bit of gray level for selection gray level for a next frame (thereafter, the above processing is repeated). On the other hand, if the result of judgment at Step Q9 shows that the screen renewing processing is terminated, the series of processing is terminated.

Thus, in the third exemplary embodiment, the same effect as obtained in the first exemplary embodiment can be achieved.

Additionally, according to the third exemplary embodiment, by setting the reference voltages of +Vd, 0V, and −Vd to be applied during the low-order bit displaying period to be lower than the voltages +Vu, 0V, and −Vu (for example, Vd=8V and Vu=15V) to be applied during the high-order bit displaying period and by decreasing the response speed of the electrophoretic display element only in the low-bit displaying period, very fine and minute gray level control can be realized without raising a frame frequency.

Further, in the third exemplary embodiment, the response speed of the electrophoretic display element is made slow only during the low-bit order displaying period and, therefore, during the black and white resetting periods, the response speed of the electrophoretic display element still remains high, thereby shortening the renewing time of a screen, as a whole, compared with that in the first exemplary embodiment.

Also, raising the speed of renewing a screen can be realized without relying on an increase in the frame frequency, thus avoiding the increase in power consumption and preventing the occurrence of the problem of insufficient writing of signals to the data driver and/or a TFT (Thin Film Transistor) which enables the device to be also applied to a high-definition panel.

In the third exemplary embodiment, by changing a reference voltage of a data driver for every frame, a voltage outputted from the data driver during the high-order bit displaying period and a voltage outputted from the data driver during the low-order bit displaying period is changed. However, the driving method is not limited to this and, for example, by using the data driver as a quinary driver which can provide the driver data of "000"=0V, "001"=Vu, "101=−Vd, and "110"=Vd to change the LUT configurations during the high-order bit displaying period and during the low-order bit displaying period, it is made possible to achieve the same driving voltage waveform as described above. In this case, its circuit configuration and circuit operation are the same as those in the first exemplary embodiment.

While the invention has been particularly shown and described with reference to exemplary embodiments thereof, the invention is not limited to these exemplary embodiments. It will be understood by those of ordinary skill in the art that various changes in form and details may be made therein without departing from the sprit and scope of the present invention as defined by the claims. For example, the present invention can be applied not only to a reset driving method but also to a previous screen reference driving method. Also, the present invention can be applied to a combined method of the reset driving method and previous screen reference driving method. The memory element is not limited to the electrophoretic display element and an electronic liquid powder display device, cholesteric liquid crystal display device, or the like can be used as the memory element.

Furthermore, the present invention can be widely used for the electronic paper display device such as electronic books and electronic newspapers.

What is claimed is:

1. An image display device having a memory property comprising:

a display section comprising a plurality of display elements each having a memory property;

a driving unit to drive said display section at a specified output voltage; and a control unit to control said driving unit;

wherein a screen of said display section is renewed by driving for a period of time corresponding to a plurality of frames according to input gray level data of a renewed screen;

wherein said control unit controls said driving unit to sequentially drive each display element with a coarse gray level at said specified output voltage specified by a high-order bit of gray level data of said renewed screen during a first displaying period in a renewing period corresponding to said plurality of frames and with a fine and minute gray level at said specified output voltage specified by a low-order bit of gray level data of said renewed screen during a second displaying period in said renewing period.

2. An image display device having a memory property comprising:

a display section comprising a plurality of display elements each having a memory property;

a driving unit to drive said display section at a specified output voltage; and a control unit to control said driving unit;

wherein a screen of said display section is renewed by driving for a period of time corresponding to a plurality of frames according to input gray level data of a renewed screen;

wherein said control unit controls said driving unit to sequentially drive each display element with a coarse gray level at said specified output voltage specified, for every frame, by a high-order bit of gray level data of said renewed screen during a first displaying period in a renewing period corresponding to said plurality of frames and with a fine and minute gray level at said specified output voltage specified, for every frame, by a low-order bit of gray level data of said renewed screen during a second displaying period in said renewing period.

3. The image display device having the memory property according to claim 2, wherein said control unit makes a response speed of said display element during said second displaying period become slower compared with a response speed of said display element during said first displaying period by operating said driving unit at an output voltage being lower than an output voltage during said first displaying period.

4. The image display device having the memory property according to claim 2, wherein said control unit operates said driving unit during said second displaying period at a frame frequency being higher than a frame frequency during said first displaying period.

5. The image display device having the memory property according to claim 2, further comprising a look up table determined for every frame which is a table describing a group of specified conversion coefficients required for calculating driving data to determine an output voltage for said driving unit for every frame and said output voltage for every frame is determined by referring to said look up table.

6. The image display device having the memory property according to claim 2, further comprising a look up table determined for every frame which is a table describing a group of specified conversion coefficients required for calculating driving data to determine an output voltage for said driving unit for every frame based on gray level data of a previous screen and gray level data of a renewed screen, and configured to determine said specified output voltage for every frame by referring to said look up table.

7. The image display device having the memory property according to claim 2, wherein said displaying section comprises an electrophoretic display element having a memory property.

8. A driving method for driving an image display device having a memory property, the image display device having a display section comprising a plurality of display elements each having a memory property, a driving unit to drive said display section at a specified output voltage, and a control unit to control said driving unit and for renewing a screen of said display section by driving for a period of time corresponding to a plurality of frames according to input gray level data of a renewed screen, said driving method comprising:

dividing a renewing period corresponding to said plurality of frames into, at least, a first displaying period and a second displaying period;

controlling said driving unit to sequentially drive each display element with a coarse gray level at said specified output voltage specified by a high-order bit of gray level data of said renewed screen during said first displaying period and with a fine and minute gray level at said specified output voltage specified by a low-order bit of gray level data of said renewed screen during said second displaying period.

9. A driving method for driving an image display device having a memory property, the image display device having a display section comprising a plurality of display elements each having a memory property, a driving unit to drive said display section at a specified output voltage, and a control unit to control said driving unit and for renewing a screen of said display section by driving for a period of time corresponding to a plurality of frames according to input gray level data of a renewed screen, said driving method comprising:

dividing a renewing period corresponding to said plurality of frames into, at least, a first displaying period and a second displaying period;

controlling said driving unit to sequentially drive each display element with a coarse gray level at said specified output voltage specified, for every frame, by a high-order bit of gray level data of said renewed screen during said first displaying period and with a fine and minute gray level at said specified output voltage specified, for every frame, by a low-order bit of gray level data of said renewed screen during said second displaying period.

10. The driving method for driving an image display device having a memory property according to claim 9, making a response speed of said display element during said second displaying period become slower compared with a response speed of said display element during said first displaying period by operating said driving unit at an output voltage being lower than an output voltage during said first displaying period.

11. The driving method for driving an image display device having a memory property according to claim 9, operating said driving unit during said second displaying period at a frame frequency being higher than a frame frequency during said first displaying period.

12. The driving method for driving an image display device having a memory property according to claim 9, determining said specified output voltage for every frame by referring to a look up table determined for every frame, the look up table describing a group of specified conversion coefficients required for calculating driving data to determine an output voltage for said driving unit for every frame.

13. The driving method for driving an image display device having a memory property according to claim 9, determining said specified output voltage for every frame by referring to a look up table determined for every frame, the look up table describing a group of specified conversion coefficients required for calculating driving data to determine an output voltage for said driving unit for every frame based on gray level data of a previous screen and gray level data of a renewed screen.

14. The driving method for driving an image display device having a memory property according to claim 9, wherein said displaying section comprises an electrophoretic display element having a memory property.

15. A driving control device to be used for an image display device having a memory property comprising a display section comprising a plurality of display elements each having a memory property, a driving unit to drive said display section at a specified output voltage, and a control unit to control said driving unit, the driving control device which functions as said control unit, wherein, at time when a screen of said display section is renewed by driving for a period of time corresponding to a plurality of frames according to input gray level data of a renewed screen, said driving unit sequentially drives each display element with a coarse gray level at said specified output voltage specified by a high-order bit of gray level data of said renewed screen during a first displaying period in a renewing period corresponding to a plurality of frames and with a fine and minute gray level at said specified output voltage specified by a low-order bit of gray level data of said renewed screen during a second displaying period in said renewing period.

16. A driving control device to be used for an image display device having a memory property comprising a display section comprising a plurality of display elements each having a memory property, a driving unit to drive said display section at a specified output voltage, and a control unit to control said driving unit, the driving control device which functions as said control unit, wherein, at time when a screen of said display section is renewed by driving for a period of time corresponding to a plurality of frames according to input gray level data of a renewed screen, said driving unit sequentially drives each display element with a coarse gray level at said specified output voltage specified, for every frame, by a high-order bit of gray level data of said renewed screen during a first displaying period in a renewing period corresponding to a plurality of frames and with a fine and minute gray level at said specified output voltage specified, for every frame, by a low-order bit of gray level data of said renewed screen during a second displaying period in said renewing period.

17. The driving control device according to claim 16, further comprising a function for making a response speed of said display element during said second displaying period become slower compared with a response speed of said display element during said first displaying period by operating said driving unit at an output voltage being lower than an output voltage during said first displaying period.

18. The driving control device according to claim 16, configured to operate said driving unit during said second displaying period at a frame frequency being higher than a frame frequency during said first displaying period.

19. The driving control device according to claim 16, further comprising a look up table determined for every frame which is a table describing a group of specified conversion coefficients required for calculating driving data to determine an output voltage for said driving unit for every frame, and configured to determine said output voltage for every frame by referring to said look up table.

20. The driving control device according to claim 16, further comprising a look up table determined for every frame which is a table describing a group of specified conversion coefficients required for calculating driving data to determine an output voltage for said driving unit for every frame based on gray level data of a previous screen and gray level data of a renewed screen, and configured to determine said specified output voltage for every frame by referring to said look up table.

* * * * *